United States Patent [19]

Haruuchi et al.

[11] Patent Number: 4,910,125

[45] Date of Patent: Mar. 20, 1990

[54] METHOD FOR PROCESSING A SILVER HALIDE COLOR PHOTOGRAPHIC MATERIALS

[75] Inventors: Taku Haruuchi; Shinji Ueda, both of Kanagawa, Japan

[73] Assignee: Fuji Photo Film Co., Ltd., Kanagawa, Japan

[21] Appl. No.: 252,968

[22] Filed: Oct. 4, 1988

[30] Foreign Application Priority Data

Oct. 5, 1987 [JP] Japan ..... 62-251378

[51] Int. Cl.[4] ..... G03C 7/42

[52] U.S. Cl. ..... 430/393; 430/430; 430/460; 430/461

[58] Field of Search ..... 430/393, 430, 460, 461, 430/491

[56] References Cited

U.S. PATENT DOCUMENTS

| | | | |
|---|---|---|---|
| 4,294,914 | 10/1981 | Fyson | 430/430 |
| 4,537,856 | 8/1985 | Kurematsu et al. | 430/393 |
| 4,601,975 | 7/1986 | Koboshi et al. | 430/393 |

*Primary Examiner*—Hoa Van Le

*Attorney, Agent, or Firm*—Sughrue, Mion, Zinn, Macpeak & Seas

[57] ABSTRACT

A method of processing an exposed silver halide color photographic material is described, comprising the steps of:

(1) color developing the material, and then (2) bleaching or bleach-fixing the material using a processing solution, wherein the processing solution has a bleaching capability and contains at least ferric complex salt of an organic chelating compound represented by formula (X):

(X)

wherein Y represents l, m and n each represents an integer of from 1 to 3 which may be the same or different; and r represents a hydrogen atom or a substituted or unsubstituted alkyl group having from 1 to 4 carbon atoms.

7 Claims, No Drawings

METHOD FOR PROCESSING A SILVER HALIDE COLOR PHOTOGRAPHIC MATERIALS

FIELD OF THE INVENTION

The present invention relates to a method for development-processing (hereinafter simply referred to as "processing") an exposed silver halide color photographic materials (hereinafter referred to as "color photosensitive materials") and, in particular, it relates to a rapid processing method in which the desilvering performance is improved.

BACKGROUND OF THE INVENTION

Generally speaking, the basic steps in the processing of color photosensitive materials are the color developing step and the desilvering step. In the color developing step, the exposed silver halide is reduced by the color developing agent to produce silver, and the oxidized color developing agent reacts with a coupler to give a color image. The silver formed is oxidized by means of a bleaching agent in the following desilvering step, and subjected to the action of a fixing agent, thereby converting it to a soluble silver complex, which is then dissolved away, so that only the color image is produced in the color photosensitive material.

In addition to the above basic steps, actual processing will also include various auxiliary steps for maintaining the photographic or physical quality of the image, or for improving image stability, etc. For example, there will be employed a hardening bath, stopping bath, image stabilizing bath and washing bath, etc.

Recently, there has been a considerable demand in the industry for more rapid processing, that is to say, a reduction in the time required for processing. In particular, shortening the desilvering step which takes up nearly half of the processing time has become an important problem.

In general, red prussiate of potash, bichromates, ferric chloride, ferric complex salts of aminopolycarboxylic acids, and persulfates, etc., are known as bleaching agents.

However, because of the problems of pollution associated with cyanide compounds and hexavalent chromium, the use of red prussiate of potash and bichromates requires special processing equipment. Further, in the case of ferric chloride, there are difficulties such as the formation of iron hydroxide in the subsequent washing step and the occurrence of stains, so there are various impediments to its practical application. The bleaching action of persulfates is extremely weak and they have the disadvantage of requiring very long bleaching times. Moreover, there are controls on persulfates as a hazardous material under the Fire Laws, and various measures are required for their storage, etc., so that in general they have the disadvantage of being difficult to employ practically.

Ferric complex salts of aminopolycarboxylic acids (in particular, the ferric complex salt of ethylenediaminetetraacetic acid) are currently the most widely used bleaching agents because there is little problem in terms of pollution therewith and there are no storage problems of the kind associated with persulfates. However, it is difficult to say that the bleaching strength of such ferric complex salts of aminopolycarboxylic acids is wholly sufficient.

As a means for making the desilvering step more rapid, a bleach-fixing solution is known which contains, in one solution, a ferric complex salt of an aminopolycarboxylic acid and a thiosulfate, as described in German Pat. No. 866,605. However, in this case, there is the disadvantage that since the ferric complex salt of the aminopolycarboxylic acid, which inherently has a weak oxidizing strength (bleaching power), is present along with a thiosulfate, which has a reducing capacity, its bleaching power is markedly lowered, particularly, in high sensitive and high silver content photographic color photosensitive materials, it is extremely difficult to achieve sufficient desilvering, and so it is impractical. On the other hand, methods for raising the bleaching power adding various types of bleaching accelerators to the bleaching bath or bleach-fixing bath, or alternatively to the bath before these have been proposed. Examples of such bleaching accelerators are various mercapto compounds as described in U.S. Pat. No. 3,893,858, British Pat. No. 1,138,842 and JP-A-53-141623 (the term "JP-A" as used herein refers to a "published unexamined Japanese patent application"), compounds which contain a disulfide bond as described in JP-A-53-95630, thiazolidine derivatives as described in JP-B-53-9854 (the term "JP-B" as used herein refers to an "examined Japanese patent publication"), isothiourea derivatives as described in JP-A-53-94927, thiourea derivatives as described in JP-B-45-8506 and JP-B-49-26586, thioamide compounds as described in JP-A-49-42349, dithiocarbamates as described in JP-A-55-26506, and arylenediamine compounds as described in U.S. Pat. No. 4,552,834.

Among these bleaching accelerators, there are some which do exhibit a definite bleach accelerating effect, but they are expensive or they have inadequate stability in a bath with a bleaching capability, and so they remain unsatisfactory for a practical use.

In *Research Disclosure*, RD No. 24023 (Apr., 1984) and JP-A-60-230653, treatment methods are described in which two or more types of ferric complex salts of aminopolycarboxylic acids are used together, but these methods too do not exhibit a sufficient bleach accelerating effect.

Again in U.S. Pat. No. 4,294,914, JP-A-49-84652, JP-A-60-230653, JP-A-62-71954 and JP-A-62-85248, methods are described in which the iminodiacetic acid ferric complex salt, methyliminodiacetic acid ferric complex salt, and hydroxyethyliminodiacetic acid ferric complex salt are used.

However, while there is sufficient bleaching action in the case of the iminodiacetic acid ferric complex salt and the methyliminodiacetic acid ferric complex salt, they have inadequate stability in the bleach-fixing bath, and there is also a problem of stain formation (bleach fogging), etc., so that there are various impediments to their practical use. The bleaching action of the hydroxyethyliminodiacetic acid ferric complex salt is insufficient, and so inadequate for practical use.

SUMMARY OF THE INVENTION

Accordingly, one object of the present invention is to provide a rapid desilvering processing method for color photosensitive materials.

Another object of the present invention is to provide a rapid desilvering processing method with stable photographic performance.

Still another object of the present invention is to provide a rapid desilvering processing method with few problems in terms of pollution.

The above-described objects have been met by a method for processing an exposed silver halide color photographic material comprising the steps of (1) color-developing the material, and then (2) bleaching or bleach-fixing the material using a processing solution, wherein the processing solution has a bleaching capability and contains at least ferric complex salt of an organic chelating compound represented by formula (X):

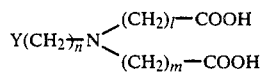

(X)

wherein Y represents

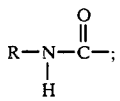

l, m and n each represents an integer of from 1 to 3 which may be the same or different, and R represents a hydrogen atom or a substituted or unsubstituted alkyl group having from 1 to 4 carbon atoms.

DETAILED DESCRIPTION OF THE INVENTION

In particular, it is preferred that l, m and n be 1 or 2, and that R be a hydrogen atom, an ethyl group or a methyl group. Moreover, the alkyl group may be substituted with a hydroxyl group, a carboxyl group, or a halogen atom such as chlorine.

If the number of carbon atoms in R is 5 or more, the bleaching capability is markedly reduced, so that this is undesirable.

That is, in the present invention, the ferric complex salt of the organic chelating compound represented by formula (X) acts as a bleaching agent.

Specific examples of the compounds represented by formula (X) is provided, but the present invention is not restricted to these.

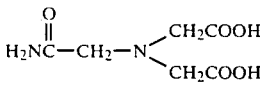

X-1

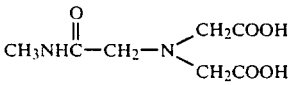

X-2

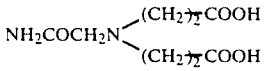

X-3

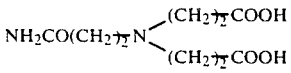

X-4

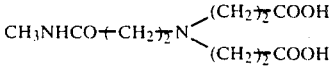

X-5

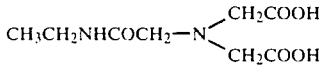

X-6

-continued

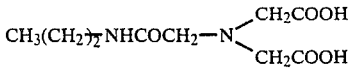

X-7

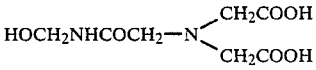

X-8

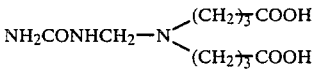

X-9

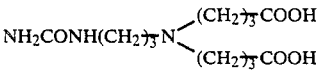

X-10

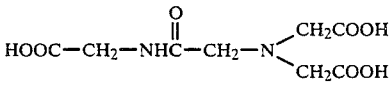

X-11

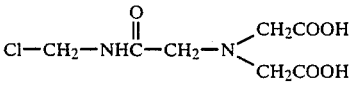

X-12

The compounds used in the present invention are commercially available, or they may be synthesized readily. In particular, "Compound X-1" is marketed by Dojin Yakkagaku Kenkyujo (Co.).

In the present invention, the processing solution having a bleaching capability is a processing solution having the capability of bleaching (oxidizing) the silver formed in the developing step, and it normally includes processing solutions known as bleaching solutions (i.e., bleaching baths) and those known as bleach-fixing solutions (i.e., bleach-fixing baths).

In the present invention, the amount of bleaching agent (i.e., ferric complex salts of organic chelating compounds) contained in the processing solution having a bleaching capability is generally from 0.05 mol to 1 mol per liter of the processing solution. In the case where the processing solution having a bleaching capability is a bleaching solution, the amount of bleaching agent is preferably from 0.1 mol to 1 mol per liter, and particularly preferably from 0.2 mol to 0.5 mol per liter. Further, in the case where the processing solution having a bleaching capability is a bleach-fixing solution, the amount of bleaching agent is preferably from 0.05 mol to 0.5 mol per liter, and particularly preferably from 0.1 mol to 0.3 mol per liter.

In the present invention, the organic chelating compound (chelating agent) represented by formula (X) may either be used in the form of its ferric complex salt, or the ferric complex ion which may be formed in solution by using the organic chelating compound together with a ferric salt, such as ferric sulfate, ferric chloride, ferric nitrate, ferric ammonium sulfate, ferric phosphate, or the like. In the case where it is used in the form of the complex salt, one type of such complex salt or more than one may be used. As such the complex salt, a ferric ammonium salt of organic chelating compound of the present invention is preferred. In the case where the complex salt is formed in solution using a ferric salt and the organic chelating compound represented by formula (X), one such ferric salt or more than one may be used. Furthermore, one or more than one type of the organic chelating compound represented by formula (X) may be used. In either case, the organic chelating compound represented by formula (X) may be used in excess of that required to form a complex salt with the ferric ions. These organic chelating compounds may be a sodium salt, a potassium salt, a lithium salt, or an ammonium salt. In the case where the organic chelating compound is used in excess of the required amount, the excessive organic chelating compound is used in an amount of preferably 50 mol % or less and more preferably 20 mol % or less per the bleaching agent of the present invention (i.e., ferric complex salt of the organic chelating compound).

A known ferric complex salt of an aminopolycarboxylic acid may also be used together with the ferric complex salt of the organic chelating compound of the present invention. Examples of the aminopolycarboxylic acid compounds of a ferric aminopolycarboxylic acid complex salt which can be used along with the ferric complex salt of the organic chelating compound of the present invention in this way include the following:

B- 1 Ethylenediaminetetraacetic acid
B- 2 Ethylenediaminetetraacetic acid disodium salt
B- 3 Ethylenediaminetetraacetic acid diammonium salt
B- 4 Ethylenediaminetetraacetic acid tetra(trimethylammonium) salt
B- 5 Ethylenediaminetetraacetic acid tetrapotassium salt
B- 6 Ethylenediaminetetraacetic acid tetrasodium salt
B- 7 Ethylenediaminetetraacetic acid trisodium salt
B- 8 Diethylenetriaminepentaacetic acid
B- 9 Diethylenetriaminepentaacetic acid pentasodium salt
B-10 Ethylenediamine-N-(β-oxyethyl)-N,N',N'-triacetic acid
B-11 Ethylenediamine-N-(β-oxyethyl)-N,N',N'-triacetic acid trisodium salt
B-12 Ethylenediamine-N-(β-oxyethyl)-N,N',N'-triacetic acid triammonium salt
B-13 1,2-Diaminopropanetetraacetic acid
B-14 1,2-Diaminopropanetetraacetic acid disodium salt
B-15 Nitrilotriacetic acid
B-16 Nitrilotriacetic acid trisodium salt
B-17 1,2-Diaminocyclohexanetetraacetic acid
B-18 1,2-Diaminocyclohexanetetraacetic acid disodium salt
B-19 Iminodiacetic acid
B-20 Dihydroxyethylglycine
B-21 Ethyl ether diaminetetraacetic acid
B-22 Glycol ether diaminetetraacetic acid
B-23 Ethylenediaminetetrapropionic acid
B-24 1,3-Diaminopropanetetraacetic acid When the ferric complex salt of the organic chelating compound of the present invention and the ferric complex salt of an aminopolycarboxylic acid are used together, one type of each of such complex salt, or more than one type of either or both, may be used together.

Furthermore, the ferric complex salt of the organic chelating compound of the present invention may be used together with the aforesaid aminopolycarboxylic acid compound of a ferric aminopolycarboxylic acid complex salt.

In the case where the ferric complex salt of the organic chelating compound of the present invention is used together with at least one of the aforesaid aminopolycarboxylic acid compound of a ferric aminopolycarboxylic acid complex salt or the ferric aminopolycarboxylic acid complex salt, their respective proportions expressed as a mol ratio preferably range from $\frac{1}{8}$ to 10/1, and particularly preferably from $\frac{1}{3}$ to 5/1.

It is possible to add known compounds as fixing agents to the processing solution having a bleaching capability of the present invention. For example, it is possible to use a thiosulfate such as sodium thiosulfate, ammonium thiosulfate, ammonium sodium thiosulfate, or potassium thiosulfate; a thiocyanate such as sodium thiocyanate, ammonium thiocyanate or potassium thiocyanate; thiourea; or a thioether, etc. Among these, preferred fixing agents include sodium thiosulfate, ammonium thiosulfate, sodium thiocyanate, and ammonium thiocyanate. The amount of such a fixing agent added is preferably 3 mol or less, and particularly preferably from 0.5 to 2 mol, per liter of the processing solution.

Compounds which are known conventionally as bleaching accelerators can be added to the processing solution having a bleaching capability of the present invention. Examples of the bleaching accelerators which can be used include the compounds with a mercapto or disulfide group described in U.S. Pat. No. 3,893,858, German Pat. No. 1,290,812, JP-A-50-95630, and *Research Disclosure*, RD No. 17129 (July, 1978); the thiazolidine derivatives described in JP-A-50-140129; the thiourea derivatives described in U.S. Pat. No. 3,706,561; the iodides described in JP-A-58-16235; the polyethylene oxides described in German Pat. No. 2,748,430; the compounds having a mercapto group or a disulfide bond, isothiourea derivatives and thiazolidine derivatives, described in JP-A-61-75352; and the polyamine compounds described in JP-B-45-8836. The compounds having a mercapto group or a disulfide bond, isothiourea derivatives and thiazolidine derivatives, described in JP-A-61-75352 are especially preferred. It is also possible to employ such bleaching accelerators by addition to the bath prior to the processing solution having a bleaching capability of the present invention.

In addition to the bleaching agent and the aforesaid compounds, it is also possible to contain in the processing solution having a bleaching capability of the present invention a rehalogenating agent such as a bromide (e.g., potassium bromide, sodium bromide or ammonium bromide), or a chloride (e.g., potassium chloride, sodium chloride, or ammonium chloride). Further, it is possible to contain one or more of the known additives normally used in a bleaching solution, for example, an inorganic acid, organic acid, or inorganic or organic acid salt, having a pH buffering capacity, such as nitrate (e.g., sodium nitrate, ammonium nitrate), boric acid, borax, sodium metaborate, acetic acid, sodium acetate, sodium carbonate, potassium carbonate, phosphorous acid, phosphoric acid, sodium phosphate, citric acid, sodium citrate, or tartaric acid.

Additives which can be included in bleach-fixing solution such as sulfites, bisulfites, various types of buffers and chelating agents, etc., can all be added in the present invention.

The pH of the processing solution having a bleaching capability of the present invention is preferably from 4.0 to 8.0.

The processing solution having a bleaching capability of the present invention may be used as a bleaching bath or may be used as a bleach-fixing bath.

Moreover, it may also be used as a bleaching-bleach-fixing bath of the kind described in JP-A-61-75352. The processing bath having a bleaching capability of the present invention may be provided immediately after the color developing bath, or it may be provided after a washing bath or an intermediate bath.

The processing temperature and processing time employed for the processing solution having a bleaching capability of the present invention will differ depending on the type of photographic material and the particular composition of the processing solution, etc., but normally a temperature of about 20° to 60° C. and particularly 30° to 40° C., and a time within about 6 minutes (particularly within about 4 minutes) is preferred.

The color developing solution used in the development processing of the photosensitive material in the present invention is preferably an aqueous alkaline solution in which the chief component is an aromatic primary amine type color developing agent. Aminophenol type compounds are useful as the color developing agent, but a p-phenylenediamine type compound is particularly preferably employed. The specific examples include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and the salts of these compounds with sulfuric acid, hydrochloric acid or p-toluenesulfonic acid, etc. It is possible to employ two or more of these compounds together depending on the objectives.

The color developing solution also generally include a pH buffer such as alkali metal carbonate, borate or phosphate; or a development inhibitor or antifoggant such as bromide, iodide, benzimidazoles, benzothiazoles, or mercapto compound. If desired, there may be used various types of preservatives such as hydroxylamine, diethyl hydroxylamine, hydrazine sulfites, phenyl semicarbazides, triethanolamine, catechol sulfonic acids and triethylenediamine(1,4-diazabicyclo[2,2,2]-octane); organic solvents such as ethylene glycol and diethylene glycol; development accelerators such as benzyl alcohol, polyethylene glycol, quaternary ammonium salts, or amines, color-forming couplers, competitive couplers, fogging agents such as sodium borohydride, auxiliary developers such as 1-phenyl-3-pyrazolidone, tackifiers, and chelating compounds typified by aminopolycarboxylic acids, aminopolyphosphonic acids, alkylphosphonic acids and phosphonocarboxylic acids, such as ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethyenediaminedi(o-hydroxyphenylacetic acid) and their salts.

Further, in the case where a reversal process is performed, normally the color development follows black-and-white development. As the black-and-white developing solution, known black-and-white developers such as dihydroxybenzenes (e.g., hydroquinone), 3-pyrazolidones (e.g., 1-phenyl-3-pyrazolidone), and aminophenols (e.g., N-methyl-p-aminophenol) can be used singly or in combination.

The pH of the color developing solution or of the black-and-white developing solution is generally 9 to 12. Further, while it depends on the particular color photographic photosensitive material being processed, the amount of replenishment of such developing solution is in general 3 liters or less per square meter of the photosensitive material, and by reducing the bromide ion concentration in the replenisher, this can be reduced to 500 ml or less. In the case where the amount of replenisher is reduced, it is preferred that evaporation of the solution and air oxidation be prevented by reducing the area of contact with air in the treatment tank. Further, it is also possible to reduce the amount of replenisher by employing a means for suppressing the accumulation of bromide ions in the developing solution.

The amount of water to be used in the rinsing step can be set in a broad range in accordance with the characteristic of the photographic photosensitive material being processed (for example, depending upon the raw material components, such as coupler, etc.) or the use of the material, as well as the temperature of the rinsing water, the number of the rinsing tank (i.e., the number of the rinsing stage), the replenishment system of cocurrent or countercurrent and other various kinds of conditions. Among the conditions, the relation between the number of the rinsing tanks and the amount of the rinsing water in a multistage countercurrent rinsing system can be obtained, e.g., by the method described in *Journal of the Society of Motion Picture and Television Engineers*, Vol. 64, pages 248 to 253 (May, 1955).

According to the multistage countercurrent system, the amount of the rinsing water to be used can be reduced significantly. However, because of the prolongation of the residence time of the water in the rinsing tank, bacteria would propagate in the tank, so that the floating substances (scum) generated by the propagation of bacteria would adhere to the surface of the material as being processed. Accordingly, the system would often have a problem. In the practice of the present invention for processing color photographic materials, the method for reducing calcium and magnesium, which is described in JP-A-62-288838, can be extremely effectively be used for overcoming such problem. In addition, the isothiazolone compounds and thiabendazoles described in JP-A-57-8542; chlorine series bactericides such as the chlorinated sodium isocyanurates described in JP-A-61-120145; the benzotriazoles described in JP-A-61-267761; copper ion; and other bactericides described in H. Horiguchi, *Antibacterial and Antifungal Chemistry*, and *Bactericidal and Fungicidal Techniques to Microorganisms*, edited by Association of Sanitary Technique, Japan, and *Encyclopedia of Bactericidal and Fungicidal Agents*, edited by Nippon Bactericide and Fungicide Association, etc., can also be used.

The pH value of the rinsing water to be used in the method of the present invention for processing photographic light-sensitive materials is from 4 to 9, and preferably from 5 to 8. The temperature of the rinsing water and the rinsing time can also be set variously in accordance with the characteristic of the photographic material as being processed, the use thereof, etc., and in general, the temperature is from 15° to 45° C. and the time is from 20 seconds to 10 minutes, and preferably the temperature is from 25° to 40° C. and the time is from 30 seconds to 5 minutes.

Furthermore, instead of the aforesaid water washing, it is possible to process the photosensitive material of the present invention by means of a stabilizing solution directly. In such a stabilizing process, it is possible to employ all of the known methods described in JP-A-57-8543, JP-A-58-14834 and JP-A-60-220345.

Following the aforesaid washing process, there may also be a further stabilizing process, an example of which is a stabilizing bath containing formalin and a surfactant used as the final bath for photographic color photosensitive materials. It is also possible to add various chelating agents and antifungal agents to this stabilizing bath.

The overflow solution which accompanies replenishment of the aforesaid washing and/or stabilizing solution can be reused in the desilvering step or other steps.

With the object of simplifying processing and making it more rapid, the color developing agent may be incorporated into the silver halide color photosensitive material of the present invention. For such incorporation, it is preferred that various precursors of the color developing agent be used. For example, it is possible to cite the indoaniline compounds described in U.S. Pat. No. 3,342,599, the Schiff's base type compounds described in U.S. Pat. No. 3,342,599, *Research Disclosure*, RD No. 14850 and ibid., RD No. 15159, the aldol compounds described in *Research Disclosure*, RD No. 13924, the metal complexes described in U.S. Pat. No. 3,719,492, and the urethane type compounds described in JP-A-53-135628.

If desired, there may also be incorporated into the silver halide color photographic material various types of 1-phenyl-3-pyrazolidones, with the object for accelerating the color development. Typical compounds are those described in JP-A-56-64339, JP-A-57-144547 and JP-A-58-115438.

The processing solutions in the present invention are generally used at 10° C. to 50° C. Preferably, a temperature of 33° C. to 38° C. is standard, but a higher temperature accelerates processing and reduces the processing time, while, conversely, at lower temperatures it is possible to realize enhanced image quality and improved processing solution stability. Further, processing may be carried out utilizing the cobalt intensification or hydrogen peroxide intensification described in West German Pat. No. 2,226,770 or U.S. Pat. No. 3,674,499 for the purposes of saving silver in the photosensitive materials.

The method of the present invention can be applied to any and every photographic processing which uses a color developer. For example, the method of the present invention can be applied to the photographic processing of color papers, color reversal papers, color direct positive photographic materials, color positive films, color negative films, color reversal films, etc., and in particular, is especially preferably applied to the photographic processing of color papers and color reversal papers.

The silver halide emulsions in the photographic light-sensitive materials to be processed by the method of the present invention may have any halogen compositions, for example, silver iodobromide, silver bromide, silver chlorobromide, silver chloride, etc. For example, in the case of rapid processing or processing with low replenishment for color papers, etc., a silver chlorobromide emulsion containing silver chloride in an amount of 60 mol % or more or a silver chloride emulsion is preferred, and in particular, the emulsion having a silver chloride content of from 80 to 100 mol % is most preferred. If a high sensitivity is specifically required, and the fog is required to be specifically lowered during the manufacture, storage and/or processing procedure of the photographic material, a silver chlorobromide emulsion containing silver bromide in an amount of 50 mol % or more or a silver bromide emulsion is preferred, and in particular, the silver bromide content in the emulsion is more preferably 70 mol % or more. If the silver bromide exceeds 90 mol %, rapid processing becomes difficult, but if a development accelerating means is employed, e.g., if there is used the action of a silver halide liquid agent, fogging agent, developing agent, or other such development accelerator at the time of processing, etc., it is possible to make the development more rapid to a certain degree, irrespective of the silver bromide content, and this is advantageous in some circumstances. In each case, it is undesirable to have a high silver iodide content, and this should be 3 mol % or less. Such silver halide emulsions are desirably used primarily in photosensitive materials for print, such as color paper, etc. For color photographic materials for picture-taking, a silver iodobromide and a silver chloroiodobromide are preferred, in which the silver iodide content is preferably from 3 to 15 mol %.

The silver halide grains for use in the present invention may differ in composition or phase between the inside and the surface layer thereof, may have a multiphase structure having a junction structure, or may have a uniform phase or composition throughout the whole grain. Also, the silver halide grains may be composed of a mixture of such grains having different phase structures.

The average grain size (the diameter of the grain is used when the grain is spherical or resembles spherical, the average value based on the project area using the edge length as the grain size is used when the grain is a cubic grain, or the diameter of the corresponding circle is used when the grain is a tabular grain) of the silver halide grains for use in the present invention is preferably from 0.1 μm to 2 μm, and more preferably from 0.15 μm to 1.5 μm. The grain size distribution of the silver halide emulsion for use in the present invention may be narrow or broad, but a so-called monodispersed silver halide emulsion wherein the value (variation coefficient) obtained by dividing the standard deviation in the grain distribution curve by the average grain size is within about 20%, and preferably within 15%, is preferably used in the present invention. Also, for satisfying the gradation required for the color photographic material, two or more kinds of monodispersed silver halide emulsions (preferably having the abovementioned variation coefficient as the monodispersibility) can exist in an emulsion layer having substantially the same color sensitivity as a mixture thereof or exist in two or more emulsion layers, respectively, each having substantially the same color sensitivity. Furthermore, two or more kinds of polydispersed silver halide emulsions or a combination of a monodispersed emulsion and a polydispersed emulsion can be used in one emulsion layer as a mixture thereof, or in two or more layers, respectively.

The silver halide grains for use in the present invention may have a regular crystal form such as cubic, octahedral, rhombic dodecahedral or tetradecahedral or a combination thereof, or an irregular crystal form such as spherical, or further a composite form of these crystal forms. Also, a tabular grain silver halide emulsion can be used in the present invention. In particular, a tabular grain silver halide emulsion wherein tabular silver halide grains having an aspect ratio (diameter/thickness) of 5 or more and preferably 8 or more, account for 50% or more of the total projected area of the silver halide grains may be used. The silver halide emulsion for use in the present invention may be a mixture of these emulsions containing silver halide grains each having different crystal forms. Also, the silver halide grains may be of a surface latent image type capable of forming latent images mainly on the surfaces thereof or of an internal latent image type capable of forming latent images mainly in the inside thereof.

The photographic emulsions for use in the present invention can be prepared by the method described in *Research Disclosure*, Vol. 176, RD No. 17643, I, II, III (December, 1978).

The photographic emulsions are generally subjected to physical ripening, chemical ripening, and spectral sensitization, for use in the present invention. The additives to be used in the steps of ripening and sensitization are described in *Research Disclosure*, Vol. 176, RD No. 17643 (December, 1978) and ibid., Vol. 187, RD No. 18716 (November, 1979), and relevant parts are summarized in the following Table.

Known photographic additives which can be used in the present invention are also described in the two *Research Disclosure* publications, and the relevant parts are also mentioned in the following Table.

| Additives | RD No. 17643 (Dec., 1978) | RD No. 18716 (Nov., 1979) |
|---|---|---|
| 1. Chemical Sensitizer | Page 23 | Page 648, right column |
| 2. Sensitivity Increasing Agents | — | Page 648, right column |
| 3. Spectral Sensitizer | Pages 23–24 | Page 648, right column to page 649, right column |
| 4. Super Color Sensitizer | Pages 23–24 | Page 648, right column to page 649, right column |
| 5. Brightening Agent | Page 24 | — |
| 6. Antifoggant, Stabilizer | Pages 24–25 | Page 649, right column |
| 7. Coupler | Page 25 | Page 649, right column |
| 8. Organic Solvent | Page 25 | — |
| 9. Light Absorbent, Filter Dye | Pages 25–26 | Page 649, right column to page 650, left column |
| 10. UV Absorbent | — | Page 650, left column |
| 11. Stain Inhibitor | Page 25, right column | Page 650, left column to right column |
| 12. Color Image Stabilizer | Page 25 | — |
| 13. Hardener | Page 26 | Page 651, left column |
| 14. Binder | Page 26 | Page 651, left column |
| 15. Plasticizer, Lubricant | Page 27 | Page 650, right column |
| 16. Coating Assistant, Surfactant | Pages 26–27 | Page 650, right column |
| 17. Antistatic Agent | Page 27 | Page 650, right column |

Various kinds of color couplers can be used in the present invention. The color coupler as referred to herein means a compound capable of forming a dye by coupling reaction with the oxidation product of an aromatic primary amine developing agent. Specific examples of useful color couplers include naphthol or phenol series compounds, pyrazolone or pyrazoloazole series compounds and open chain or heterocyclic ketomethylene compounds. Examples of the cyan, magenta and yellow couplers which can be used in the present invention are described in the patent publication as referred to in *Research Disclosure*, RD No. 17643 (Dec., 1978), VII-D and ibid,, RD No. 18717 (Nov., 1979).

It is preferred that the couplers to be incorporated into the color photographic materials which are processed by the process of the present invention are non-diffusible due to having a ballast group or being polymerized. Also, the use of 2-equivalent color couplers substituted by a releasable group can reduce the amount of silver required for the color photographic materials as compared to 4-equivalent color couplers having a hydrogen atom at the coupling active group. Couplers giving colored dyes having a proper diffusibility, non-color-forming couplers, DIR (development inhibitor releasing) couplers releasing a development inhibitor with coupling reaction, or DAR (development accelerator releasing) couplers releasing a development accelerator with coupling reaction can also be used in the present invention.

Examples of yellow couplers for use in the present invention include oil protect type acylacetamido series couplers as the typical examples. Specific examples of these couplers are described in U.S. Pat. Nos. 2,407,210, 2,875,057, 3,265,506, etc. In the present invention, 2-equivalent yellow couplers are preferably used and specific examples of these yellow couplers are the oxygen atom-releasing type yellow couplers described in U.S. Pat. Nos. 3,408,194, 3,447,928, 3,933,501, 4,022,620, etc., and the nitrogen atom-releasing type yellow couplers described in JP-B-55-10739,U.S. Pat. Nos. 4,401,752, 4,326,024, *Research Disclosure*, RD No. 18053 (Apr., 1979), British Pat. No. 1,425,020, West German Pat. (Laid-Open) Nos. 2,219,917, 2,261,361, 2,329,587, 2,433,812, etc. In these yellow couplers, α-pivaloylacetanilide couplers are excellent in fastness, in particular light fastness of colored dyes formed, while α-benzoylacetanilide couplers are excellent in coloring density.

Examples of magenta couplers for use in the present invention include oil protect type indazolone series or cyanoacetyl series couplers, and preferably 5-pyrazolone series magenta couplers and other pyrazoloazole series couplers such as pyrazoloazoles, etc. As the 5-pyrozolone series couplers, those substituted by an arylamino group or an acylamino group at the 3-position thereof are preferred from the veiwpoint of the hue and coloring density of the colored dyes formed. Specific examples of these couplers are described in U.S. Pat. Nos. 2,311,082, 2,343,703, 2,600,788, 2,908,573, 3,062,653, 3,152,896 and 3,936,015, etc. Also, as the releasable groups for the 2-equivalent 5-pyrazolone series couplers, the nitrogen atom-releasing groups described in U.S. Pat. No. 4,310,619, and the arylthio groups described in U.S. Pat. No. 4,351,897 are preferred. Furthermore, the 5-pyrazolone series magenta couplers having a ballast group described in European Pat. No. 73,636 give high coloring density.

Examples of pyrazoloazole series couplers include the pyrazolobenzimidazoles described in U.S. Pat. No. 3,369,879, preferably the pyrazolo[5,1-c][1,2,4]-triazoles described in U.S. Pat. No. 3,725,067, the pyrazolotetrazoles described in *Research Disclosure*, RD No. 24220 (June, 1984), and the pyrazolopyrazoles described in *Research Disclosure*, RD No. 24230 (June, 1984). The imidazo[1,2,-b]pyrazoles described in European Pat. No. 119,741 are preferred because of the small yellow side absorption of the colored dye and of the sufficient light fastness thereof, and in particular, the pyrazolo[1,5-b][1,2,4]triazoles described in European Pat. No. 119,860 are especially preferred.

Examples of cyan couplers for use in the present invention include oil protect type naphthol series or phenol series couplers. Specifice examples of the naphthol series couplers include the cyan couplers described in U.S. Pat. No. 2,474,293 and preferably the oxygen atom-releasing type 2-equivalent naphthol series couplers described in U.S. Pat. Nos. 4,052,212, 4,146,396, 4,228,233 and 4,296,200. Also, specific examples of the phenol series cyan couplers are described in U.S. Pat. Nos. 2,369,929, 2,801,171, 2,772,162, 2,894,826, etc. Cyan couplers having high fastness to humidity and temperature are preferably used in the present invention and specific examples of these cyan couplers include the phenol series cyan couplers having an alkyl group of 2 or more carbon atoms at the meta-position of the phenol nucleus described in U.S. Pat. No. 3,772,002; the 2,5-diacylamino-substituted phenol series cyan couplers described in U.S. Pat. Nos. 2,772,162, 3,758,308, 4,126,396, 4,334,011, 4,327,173, West German patent application (Laid-Open) No. 3,329,729, JP-A-59-166956, etc.; and the phenol series couplers having a phenylureido group at the 2-position thereof and an acylamino group at the 5-position thereof described in U.S. Pat. Nos. 3,446,622, 4,333,999, 4,451,559 and 4,427,767.

In the present invention, by using couplers giving colored dyes having a proper diffusibility together with the aforesaid color couplers, the graininess of color images formed can be improved. Specific examples of couplers giving such diffusible dyes are described in U.S. Pat. No. 4,366,237 and British Pat. No. 2,125,570, and specific examples of yellow, magenta and cyan couplers of this type are described in European Pat. No. 96,570 and West German Pat. (Laid-Open) No. 3,234,533.

The dye-forming couplers and the abovedescribed specific couplers for use in the present invention may form dimers or polymers. Typical examples of the polymerized dye-forming couplers are described in U.S. Pat. Nos. 3,451,820 and 4,080,211. Also, specific examples of the polymerized magenta couplers are described in British Pat. No. 2,102,173 and U.S. Pat. No. 4,367,282.

The various kinds of couplers for use in the present invention may be used for the same photographic layer of a color photographic material as a combination of two or more kinds thereof for meeting particular characteristics desired for a color photographic material, or the same kind of coupler may be used in two or more photographic layers for meeting desired characteristics.

The couplers for use in the present invention can be incorporated into the photographic light-sensitive materials by means of various known dispersion methods. For instance, an oil-in-water dispersion method can be mentioned as one example, and examples of high boiling point organic solvents which can be used in the oil-in-water dispersion method are described, e.g., in U.S. Pat. No. 2,322,027, etc. Another example is a latex dispersion method, and the procedure, effect, and examples of latexes to be used for impregnation are described in U.S. Pat. No. 4,199,363, West German Pat. (Laid-Open) Nos.2,541,274 and 2,541,230, etc.

The standard amount of the color coupler to be incorporated is in the range of from 0.001 to 1 mol per mol of the light-sensitive silver halide in the silver halide emulsion and the preferred amount is from 0.01 to 0.5 mol for yellow coupler, from 0.003 to 0.3 mol for magenta coupler and from 0.002 to 0.3 mol for cyan coupler.

The photographic light-sensitive material for use in the present invention is coated on a conventional flexible support such as plastic films (e.g., cellulose nitrate, cellulose acetate, polyethylene terephthalate, etc.) or paper or a conventional rigid support such as glass, etc. The details of the supports and the coating means are described in *Research Disclosure*, RD No. 17643, XV (page 27) and XVII (page 28) (December, 1978).

EXAMPLE

The following examples are intended to illustrate the present invention but not to limit it in any way.

EXAMPLE 1

A multilayer color photosensitive material, Sample 101, was produced by coating individual layers of the compositions specified below onto a cellulose triacetate film support which had been subjected to undercoating.

*Composition of the Photosensitive Layers:*

The numbers corresponding to the components specified represent coverage expressed in units of g/m$^2$. In the case of the silver halide, the figure denotes coverage based on conversion to silver. In the case of a sensitizing dye, the units are mol per mol of silver halide in the same layer.

Sample 101

| | |
|---|---|
| First Layer: Antihalation Layer | |
| Black colloidal silver | 0.18 (as Ag) |
| Gelatin | 0.40 |
| Second Layer: Interlayer | |
| 2,5-Di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Third Layer: First Red-Sensitive Emulsion Layer | |
| Monodispersed silver iodobromide emulsion (silver iodide: 6 mol %, average grain diameter: 0.6 μm, coefficient of variation in terms of grain diameter: 0.15) | 0.55 (as Ag) |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| EX-2 | 0.350 |
| HBS-1 | 0.005 |
| EX-10 | 0.020 |
| Gelatin | 1.20 |
| Fourth Layer: Second Red-Sensitive Emulsion Layer | |
| Tabular silver iodobromide emulsion (silver iodide: 10 mol %, average grain diameter: 0.7 μm, average aspect ratio: 5.5, average thickness: 0.2 μm) | 1.0 (as Ag) |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| EX-2 | 0.400 |
| EX-3 | 0.050 |
| EX-10 | 0.015 |
| Gelatin | 1.30 |
| Fifth Layer: Third Red-Sensitive Emulsion Layer | |
| Silver iodobromide emulsion (silver iodide: 16 mol %, average grain diameter: 1.1 μm) | 1.60 (as Ag) |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| EX-3 | 0.240 |
| EX-4 | 0.120 |
| HBS-1 | 0.22 |
| HBS-2 | 0.10 |
| Gelatin | 1.63 |

-continued

| | |
|---|---|
| Sixth Layer: Interlayer | |
| EX-5 | 0.040 |
| HBS-1 | 0.020 |
| Gelatin | 0.80 |
| Seventh Layer: First Green-Sensitive Emulsion Layer | |
| Tabular silver iodobromide emulsion (silver iodide: 6 mol %, average grain diameter: 0.6 μm, average aspect ratio: 6.0, average thickness: 0.15 μm) | 0.40 (as Ag) |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |
| Eighth Layer: Second Green-Sensitive Emulsion Layer | |
| Monodispersed silver iodobromide emulsion (silver iodide: 9 mol %, average grain diameter: 0.7 μm, coefficient of variation in terms of grain diameter: 0.18) | 0.80 (as Ag) |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |
| Ninth Layer: Third Green-Sensitive Emulsion Layer | |
| Silver iodobromide emulsion (silver iodide: 12 mol %, average grain diameter: 1.0 μm) | 1.2 (as Ag) |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-6 | 0.065 |
| EX-11 | 0.030 |
| EX-1 | 0.025 |
| HBS-1 | 0.25 |
| HBS-2 | 0.10 |
| Gelatin | 1.74 |
| Tenth Layer: Yellow Filter Layer | |
| Yellow colloidal silver | 0.05 (as Ag) |
| EX-5 | 0.08 |
| HBS-3 | 0.03 |
| Gelatin | 0.95 |

-continued

| | |
|---|---|
| Eleventh Layer: First Blue-Sensitive Emulsion Layer | |
| Tabular silver iodobromide emulsion (silver iodide: 6 mol %, average grain diameter: 0.6 μm, average aspect ratio: 5.7, average thickness: 0.15 μm) | 0.24 (as Ag) |
| Sensitizing Dye VIII | $3.5 \times 10^{-4}$ |
| EX-9 | 0.85 |
| EX-8 | 0.12 |
| HBS-1 | 0.28 |
| Gelatin | 1.28 |
| Twelfth Layer: Second Blue-Sensitive Emulsion Layer | |
| Monodispersed silver iodobromide emulsion (silver iodide: 10 mol %, average grain diameter: 0.8 μm, coefficient of variation in terms of grain diameter: 0.16) | 0.45 (as Ag) |
| Sensitizing Dye VIII | $2.1 \times 10^{-4}$ |
| EX-9 | 0.20 |
| EX-10 | 0.015 |
| HBS-1 | 0.03 |
| Gelatin | 0.46 |
| Thirteenth Layer: Third Blue-Sensitive Emulsion Layer | |
| Silver iodobromide emulsion (silver iodide: 14 mol %, average grain diameter: 1.3 μm) | 0.77 (as Ag) |
| Sensitizing Dye VIII | $2.2 \times 10^{-4}$ |
| EX-9 | 0.20 |
| HBS-1 | 0.07 |
| Gelatin | 0.69 |
| Fourteenth Layer: First Protective Layer | |
| Silver iodobromide emulsion (silver iodide: 1 mol %, average grain diameter: 0.07 μm) | 0.5 (as Ag) |
| U-4 | 0.11 |
| U-5 | 0.17 |
| HBS-1 | 0.90 |
| Gelatin | 1.00 |
| Fifteenth Layer: Second Protective Layer | |
| Polymethyl acrylate particles (diameter: about 1.5 μm) | 0.54 |
| S-1 | 0.15 |
| S-2 | 0.05 |
| Gelatin | 0.72 |

In addition to the components specified above, Gelatin Hardener H-1 and surfactant were added to each layer.

The chemical structural formulae or chemical names of the compounds used in the above example are shown below.

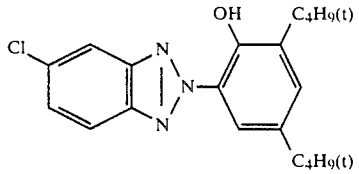

U-1

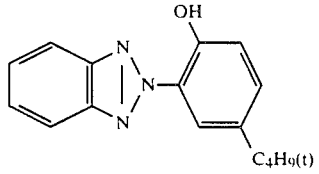

U-2

-continued
U-3
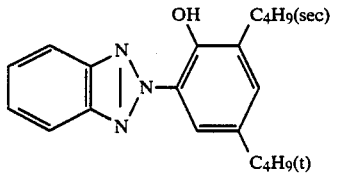
U-4
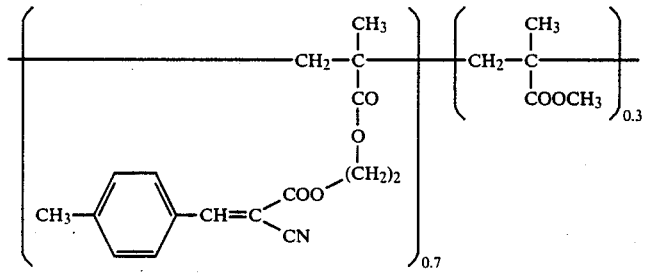
U-5
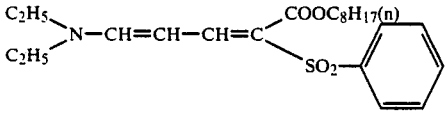
EX-1
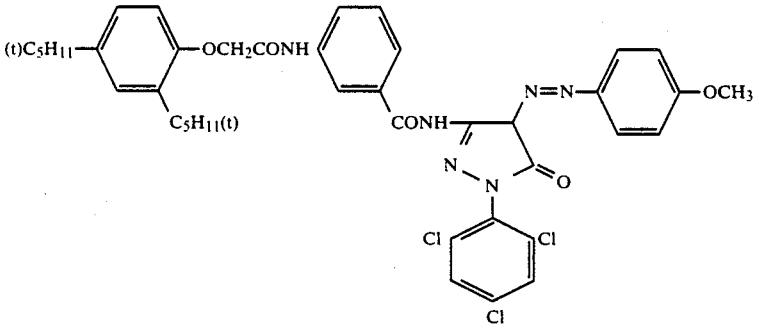
EX-2
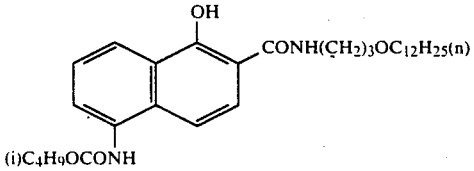
EX-3
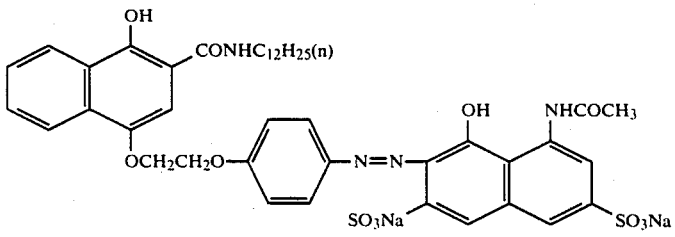
EX-4
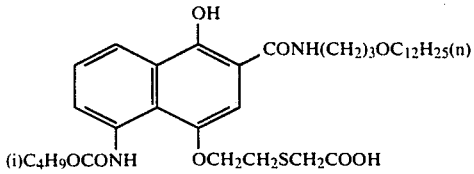

-continued
EX-5
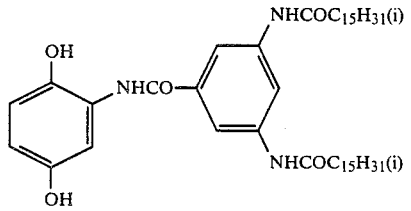
EX-6
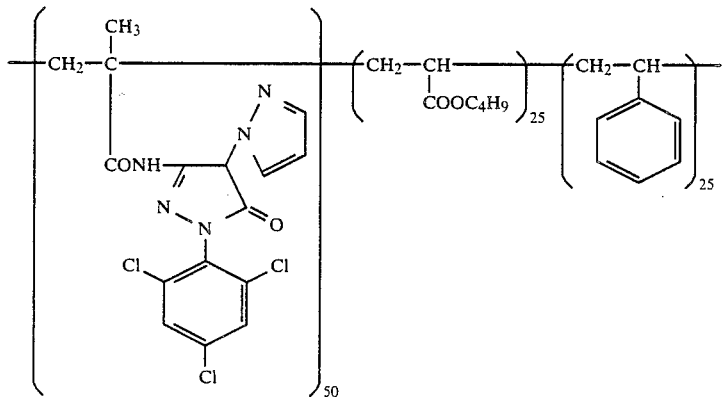
AVERAGE MOLECULAR WEIGHT: 30,000
EX-7
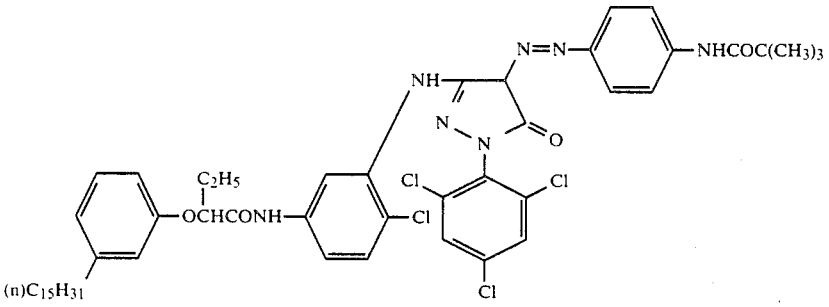
EX-8
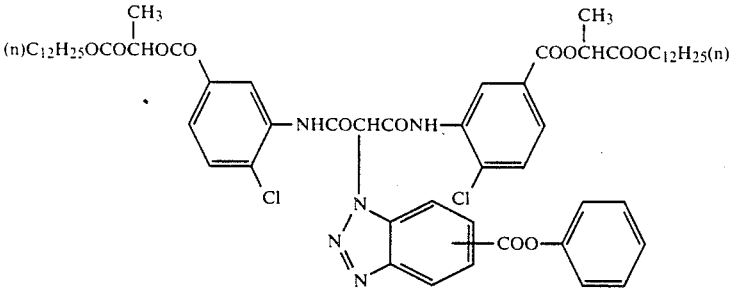
EX-9
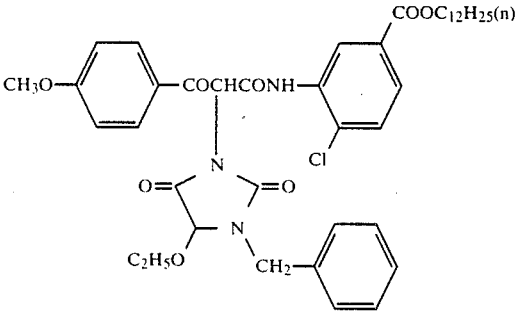

-continued
EX-10
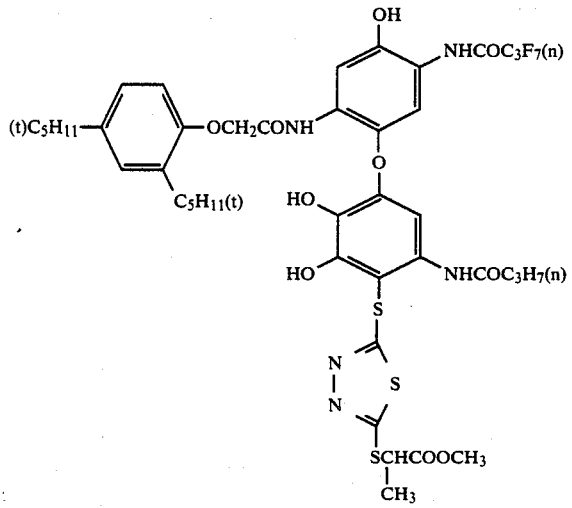
EX-11
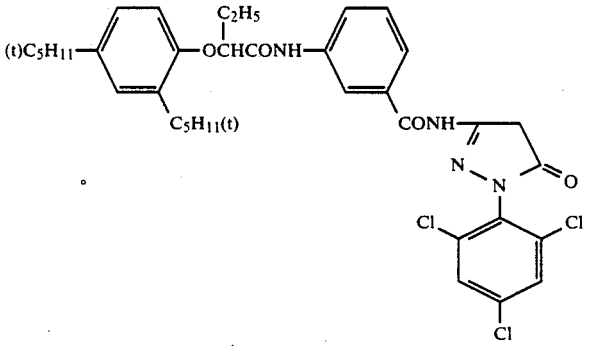
EX-12
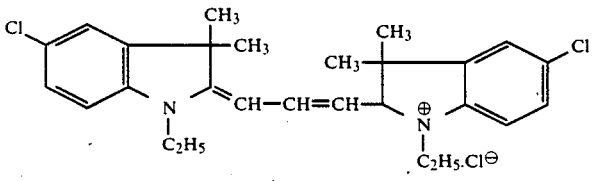
S-1
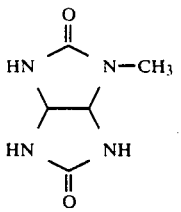
S-2
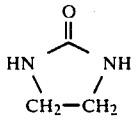
tricresyl phosphate HBS-1
dibutyl phthalate HBS-2
bis(2-ethylhexyl) phthalate HBS-3
HBS-4
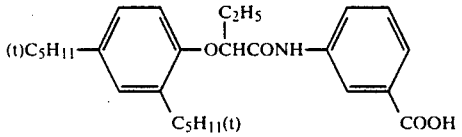

-continued
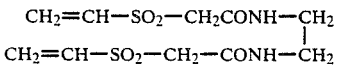
H-1
Sensitizing dyes:
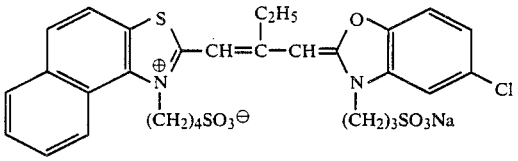
I
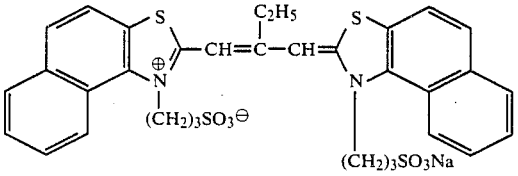
II
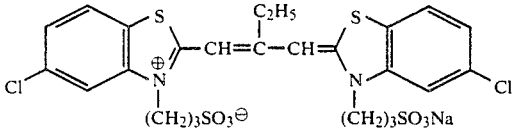
III
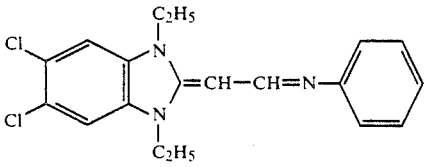
IV
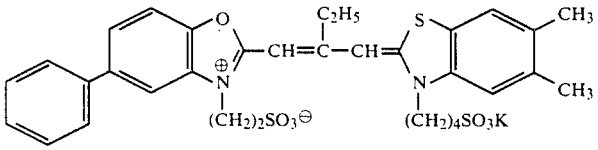
V
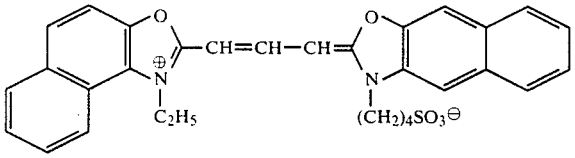
VI
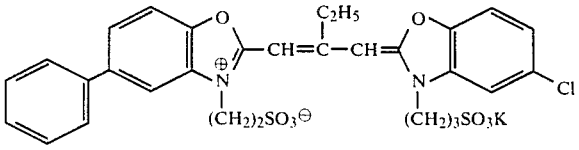
VII
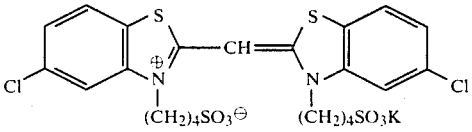
VIII -continued

IX

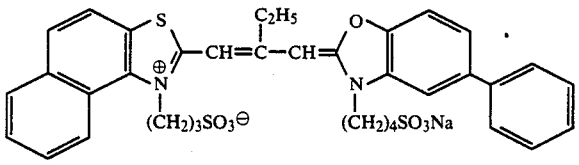

After exposing the color photographic photosensitive material described above, processing was carried out by the following method.

Processing Method

| Processing Step | Processing Time | Processing Temperature (°C.) |
|---|---|---|
| Color Development | 3 min 15 sec | 38 |
| Bleaching | 30 sec | 38 |
| Bleach-Fixing | 2 min 00 sec | 38 |
| Washing (1) | 40 sec | 35 |
| Washing (2) | 1 min 00 sec | 35 |
| Stabilizing | 40 sec | 38 |
| Drying | 1 min 15 sec | 55 |

The compositions of the treatment solutions were as follows:

| | |
|---|---|
| Color Developing Solution: | |
| Diethylenetriaminepentaacetic Acid | 1.0 g |
| 1-Hydroxyethylidene-1,1-diphosphonic Acid | 3.0 g |
| Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 4-(N-Ethyl-N-β-hydroxyethylamino)-2-methylaniline Sulfate | 4.5 g |
| Water to make | 1.0 liter |
| pH | 10.05 |
| Bleaching Solution: | |
| Bleaching Agent (ferric ammonium salts of organic chelating compound as described in Table 1) | 0.5 mol |
| Organic Chelating Compound (described in Table 1) | 0.05 mol |
| Ammonium Bromide | 100.0 g |
| Ammonium Nitrate | 10.0 g |
| Bleaching Accelerator | 0.005 mol |

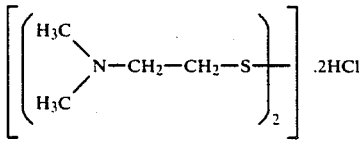

| | |
|---|---|
| Aqueous Ammonia (27 wt %) | 15.0 ml |
| Water to make | 1.0 liter |
| pH | 6.3 |
| Bleach-Fixing Solution: | |
| Bleaching Agent (identical to that in the bleaching solution) | 0.3 mol |
| Chelating Compound (identical to that in the bleaching solution) | 0.05 g |
| Sodium Sulfite | 12.0 g |
| Aqueous Ammonium Thiosulfate Solution (700 g/liter) | 240.0 ml |
| Aqueous Ammonia (27 wt %) | 6.0 ml |
| Water to make | 1.0 liter |
| pH | 7.2 |

Washing Solution:

Tap water was passed through a mixed bed-type column packed with an H-type strong acid cation exchange resin (Amberlite IR-120B, manufactured by Rohm & Haas Co.) and an OH-type anion exchange resin (Amberlite IR-400, manufactured by Rohm & Haas Co.), and the calcium and magnesium ion concentration reduced to below 3 mg per liter. Then, 20 mg per liter of sodium dichloroisocyanurate and 1.5 g per liter of sodium sulfate were added. The pH of this solution lay in the range 6.5 to 7.5.

| Stabilizing Solution: | |
|---|---|
| Formaldehyde (37 wt %) | 2.0 ml |
| Polyoxyethylene-p-monononylphenyl Ether (average degree of polymerization: 10) | 0.3 g |
| Ethylenediaminetetraacetic Acid Disodium Salt | 0.05 g |
| Water to make | 1.0 liter |
| pH | 5.0 to 8.0 |

Photosensitive materials processed as described above were then subjected to fluorescent X-ray analysis and the residual amount of silver in the region of maximum color density was measured. The results are shown in Table 1.

TABLE 1

| No. | Organic Chelating Compound | Residual Silver ($\mu m/cm^2$) | Notes |
|---|---|---|---|
| 1-1 | Ethylenediaminetetraacetic Acid | 10.3 | Comparison |
| 1-2 | Iminodiacetic Acid | 8.2 | Comparison |
| 1-3 | Methyliminodiacetic Acid | 6.1 | Comparison |
| 1-4 | Hydroxyethyliminodiacetic Acid | 53.8 | Comparison |
| 1-5 | Specified Compound X-1 | 5.0 | Invention |
| 1-6 | Specified Compound X-2 | 5.2 | Invention |
| 1-7 | Specified Compound X-3 | 5.3 | Invention |
| 1-8 | Specified Compound X-4 | 5.6 | Invention |
| 1-9 | Specified Compound X-5 | 5.1 | Invention |
| 1-10 | Specified Compound X-6 | 5.5 | Invention |
| 1-11 | Specified Compound X-7 | 5.8 | Invention |
| 1-12 | Specified Compound X-8 | 5.9 | Invention |
| 1-13 | Specified Compound X-9 | 5.4 | Invention |
| 1-14 | Specified Compound X-10 | 5.4 | Invention |

As is clear from Table 1, where a specific compound represented by formula (X) was used as the organic chelating compound for the bleaching agent in accordance with the present invention, there was little residual silver as compared to the use of a comparative compound. Further, an excellent image was obtained.

EXAMPLE 2

The multilayer color photographic photosensitive material produced in Example 1 was exposed in the same way as in Example 1, and then processed in the following steps (with the object of investigating whether or not there was bleach fogging).

Processing Method

| Processing Step | Processing Time | Processing Temperature (°C.) |
|---|---|---|
| Color Development | 3 min 15 sec | 38 |
| Bleaching | 1 min 00 sec | 38 |
| Bleach-Fixing | 3 min 15 sec | 38 |
| Washing (1) | 40 sec | 35 |
| Washing (2) | 1 min 00 sec | 35 |
| Stabilizing | 40 sec | 38 |
| Drying | 1 min 15 sec | 55 |

The compositions of the processing solutions used were identical to those in Example 1.

Measurements were made of the minimum yellow density in the processing photosensitive material in each case, and the results are shown in Table 2.

TABLE 2

| No. | Organic Chelating Compound | Minimum Yellow Density | Notes |
|---|---|---|---|
| 2-1 | Ethylenedinetetraacetic Acid | 0.81 | Comparison |
| 2-2 | Iminodiacetic Acid | 0.90 | Comparison |
| 2-3 | Methyliminodiacetic Acid | 0.88 | Comparison |
| 2-4 | Hydroxyethyliminodiacetic Acid | * | Comparison |
| 2-5 | Specified Compound X-1 | 0.80 | Invention |
| 2-6 | Specified Compound X-2 | 0.81 | Invention |
| 2-7 | Specified Compound X-3 | 0.80 | Invention |
| 2-8 | Specified Compound X-4 | 0.80 | Invention |
| 2-9 | Specified Compound X-5 | 0.81 | Invention |
| 2-10 | Specified Compound X-6 | 0.81 | Invention |
| 2-11 | Specified Compound X-7 | 0.79 | Invention |
| 2-12 | Specified Compound X-8 | 0.80 | Invention |
| 2-13 | Specified Compound X-9 | 0.79 | Invention |
| 2-14 | Specified Compound X-10 | 0.80 | Invention |

*With hydroxyethyliminodiacetic acid there was poor desilvering and so an evaluation was not performed.

As shown in Table 2, where a specified compound represented by formula (X) was used as the organic chelating compound for the bleaching agent, the yellow staining following treatment was low and an excellent image was obtained. Since there was poor desilvering when hydroxyethyliminodiacetic acid was used, evaluation was not carried out in this case.

EXAMPLE 3

A multilayer color photosensitive material, Sample 201, was produced, comprising individual layers of the composition specified below on a cellulose triacetate film base which had been subjected to undercoating.

Composition of the Photosensitive Layers

Coverage is expressed below in units of g/m$^2$ of silver in the case of the silver halide and colloidal silver, in units of g/m$^2$ in the case of the couplers, additives and gelatin, and in mols per mol of silver halide in the same layer in the case of the sensitizing dyes.

Sample 201

| | |
|---|---|
| First Layer: Antihalation Layer | |
| Black colloidal silver | 0.2 |
| Gelatin | 1.3 |
| ExM-(9) | 0.06 |
| UV-(1) | 0.03 |
| UV-(2) | 0.06 |
| UV-(3) | 0.06 |
| Solv-(1) | 0.15 |
| Solv-(2) | 0.15 |
| Solv-(3) | 0.05 |
| Second Layer: Interlayer | |
| Gelatin | 1.0 |
| UV-(1) | 0.03 |

-continued

| | |
|---|---|
| ExC-(4) | 0.02 |
| ExF-(1) | 0.004 |
| Solv-(1) | 0.1 |
| Solv-(2) | 0.1 |
| Third Layer: Slow-Speed Red-Sensitive Emulsion Layer | |
| Silver iodobromide emulsion (AgI: 4 mol %, uniform AgI type, diameter of equivalent sphere: 0.5 μm, coefficient of variation of diameter of equivalent sphere: 20%, tabular grains, diameter/thickness ratio: 3.0) | 1.2 (silver coverage) |
| Silver iodobromide emulsion (AgI: 3 mol %, uniform AgI type, diameter of equivalent sphere: 0.3 μm, coefficient of variation of diameter of equivalent sphere: 15%, spherical grains, diameter/thickness ratio: 1.0) | 0.6 (silver coverage) |
| Gelatin | 1.0 |
| ExS-(1) | $4 \times 10^{-4}$ |
| ExS-(2) | $5 \times 10^{-5}$ |
| ExC-(1) | 0.05 |
| ExC-(2) | 0.50 |
| ExC-(3) | 0.03 |
| ExC-(4) | 0.12 |
| ExC-(5) | 0.01 |
| Fourth Layer: High-Speed Red-Sensitive Emulsion Layer | |
| Silver iodobromide emulsion (AgI: 6 mol %, core/shell ratio: 1/1, high AgI interior type, diameter of equivalent sphere: 0.7 μm, coefficient of variation of diameter of equivalent sphere: 15%, tabular grains, diameter/thickness ratio: 5.0) | 0.7 (silver coverage) |
| Gelatin | 1.0 |
| ExS-(1) | $3 \times 10^{-4}$ |
| ExS-(2) | $2.3 \times 10^{-5}$ |
| ExC-(6) | 0.11 |
| ExC-(7) | 0.05 |
| ExC-(4) | 0.05 |
| Solv-(1) | 0.05 |
| Solv-(3) | 0.05 |
| Fifth Layer: Interlayer | |
| Gelatin | 0.5 |
| Cpd-(1) | 0.1 |
| Solv-(1) | 0.05 |
| Sixth Layer: Slow-Speed Green-Sensitive Emulsion Layer | |
| Silver iodobromide emulsion (AgI: 4 mol %, core/shell ratio: 1/1, high surface AgI type, diameter of equivalent sphere: 0.5 μm, coefficient of variation of diameter of equivalent sphere: 15%, tabular grains, diameter/thickness ratio: 4.0) | 0.35 (silver coverage) |
| Silver iodobromide emulsion (AgI: 3 mol %, uniform AgI type, diameter of equivalent sphere: 0.3 μm, coefficient of variation of diameter of equivalent sphere: 25%, spherical grains, diameter/thickness ratio: 1.0) | 0.20 (silver coverage) |
| Gelatin | 1.0 |
| ExS-(3) | $5 \times 10^{-4}$ |
| ExS-(4) | $3 \times 10^{-4}$ |
| ExS-(5) | $1 \times 10^{-4}$ |
| ExM-(8) | 0.4 |
| ExM-(9) | 0.07 |
| ExM-(10) | 0.02 |
| ExY-(11) | 0.03 |
| Solv-(1) | 0.3 |
| Solv-(4) | 0.05 |
| Seventh Layer: High-Speed Green-Sensitive Emulsion Layer | |
| Silver iodobromide emulsion (AgI: 4 mol %, core/shell ratio: 1/3, high AgI interior type, diameter of equivalent sphere: 0.7 μm, coefficient of variation of diameter of equivalent sphere: 20%, tabular grains, diameter/thickness ratio: 5.0) | 0.8 (silver coverage) |
| Gelatin | 0.5 |
| ExS-(3) | $5 \times 10^{-4}$ |
| ExS-(4) | $3 \times 10^{-4}$ |
| ExS-(5) | $1 \times 10^{-4}$ |

-continued

| | |
|---|---|
| ExM-(8) | 0.1 |
| ExM-(9) | 0.02 |
| ExY-(11) | 0.03 |
| ExC-(2) | 0.03 |
| ExM-(14) | 0.01 |
| Solv-(1) | 0.2 |
| Solv-(4) | 0.01 |
| Eighth Layer: Interlayer | |
| Gelatin | 0.5 |
| Cpd-(1) | 0.05 |
| Solv-(1) | 0.02 |
| Ninth Layer: Donor Layer with Interlayer Effect in Terms of the Red-Sensitive Layer | |
| Silver iodobromide emulsion (AgI: 2 mol %, core/shell ratio: 2/1, high AgI interior type, diameter of equivalent sphere: 1.0 μm, coefficient of variation of diameter of equivalent sphere: 15%, tabular grains, diameter/thickness ratio: 6.0) | 0.35 (silver coverage) |
| Silver iodobromide emulsion (AgI: 2 mol %, core/shell ratio: 1/1, high AgI interior type, diameter of equivalent sphere: 0.4 μm, coefficient of variation of diameter of equivalent sphere: 20%, tabular grains, diameter/thickness ratio: 6.0) | 0.20 (silver coverage) |
| Gelatin | 0.5 |
| ExS-(3) | $8 \times 10^{-4}$ |
| ExY-(13) | 0.11 |
| ExM-(12) | 0.03 |
| ExM-(14) | 0.10 |
| Solv-(1) | 0.20 |
| Tenth Layer: Yellow Filter Layer | |
| Yellow colloidal silver | 0.05 |
| Gelatin | 0.5 |
| Cpd-(2) | 0.13 |
| Solv-(1) | 0.13 |
| Cpd-(1) | 0.10 |
| Eleventh Layer: Slow-speed Blue-Sensitive Emulsion Layer | |
| Silver iodobromide emulsion (AgI: 4.5 mol %, uniform AgI type, diameter of equivalent sphere: 0.7 μm, coefficient of variation of diameter of equivalent sphere: 15%, tabular grains, diameter/thickness ratio: 7.0) | 0.3 (silver coverage) |
| Silver iodobromide emulsion (AgI: 3 mol %, uniform AgI type, diameter of equivalent sphere: 0.3 μm, coefficient of variation of diameter of equivalent sphere: 25%, tabular grains, diameter/thickness ratio: 7.0) | 0.15 (silver coverage) |
| Gelatin | 1.6 |
| ExS-(6) | $2 \times 10^{-4}$ |
| ExC-(16) | 0.05 |
| ExC-(2) | 0.10 |
| ExC-(3) | 0.02 |

-continued

| | |
|---|---|
| ExY-(13) | 0.07 |
| ExY-(15) | 1.0 |
| Solv-(1) | 0.20 |
| Twelfth Layer: High-Speed Blue-Sensitive Emulsion Layer | |
| Silver iodobromide emulsion (AgI: 10 mol %, high AgI interior type diameter of equivalent sphere: 1.0 μm, coefficient of variation of diameter of equivalent sphere: 25%, multiple twin crystal tabular grains, diameter/thickness ratio: 2.0) | 0.5 (silver coverage) |
| Gelatin | 0.5 |
| ExS-(6) | $1 \times 10^{-4}$ |
| ExY-(15) | 0.20 |
| ExY-(13) | 0.01 |
| Solv-(1) | 0.10 |
| Thirteenth Layer: First Protective Layer | |
| Gelatin | 0.8 |
| UV-(4) | 0.1 |
| UV-(5) | 0.15 |
| Solv-(1) | 0.01 |
| Solv-(2) | 0.01 |
| Fourteenth Layer: Second Protective Layer | |
| Fine grain silver bromide emulsion (AgI: 2 mol %, uniform AgI-type, diameter of equivalent sphere: 0.07 μm) | 0.5 |
| Gelatin | 0.45 |
| Polymethyl methacrylate particles (diameter: 1.5 μm) | 0.2 |
| H-(1) | 0.4 |
| Cpd-(5) | 0.5 |
| Cpd-(6) | 0.5 |

In addition to the above components, Emulsion Stabilizing Compound Cpd-(3) (0.04 g/m$^2$) and Surfactant Cpd-(4) (0.02 g/m$^2$) were added as coating aids to the layers.

UV-(1): same as U-1 in Example 1
UV-(2): same as U-2 in Example 1
UV-(3): same as U-3 in Example 1
UV-(4): same as U-4 in Example 1
UV-(5): same as U-5 in Example 1
Solv-(1): tricresyl phosphate
Solv-(2): dibutyl phthalate Solv-(3)

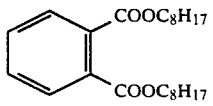

Solv-(4): same as HBS-4 in Example 1

Cpd-(1)

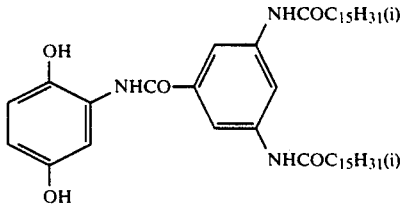

Cpd-(2)

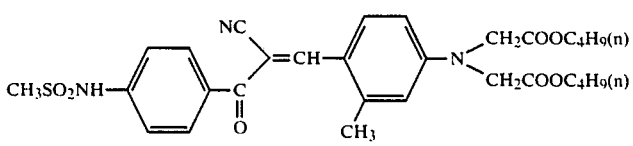

-continued
Cpd-(3)
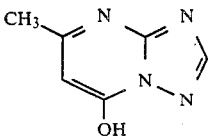
Cpd-(4)
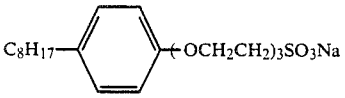
Cpd-(5): same as S-1 in Example 1
Cpd-(6): same as S-2 in Example 1
ExC-(1)
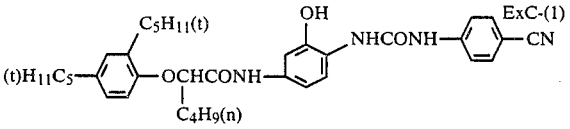
ExC-(2): same as EX-2 in Example 1
ExC-(3)
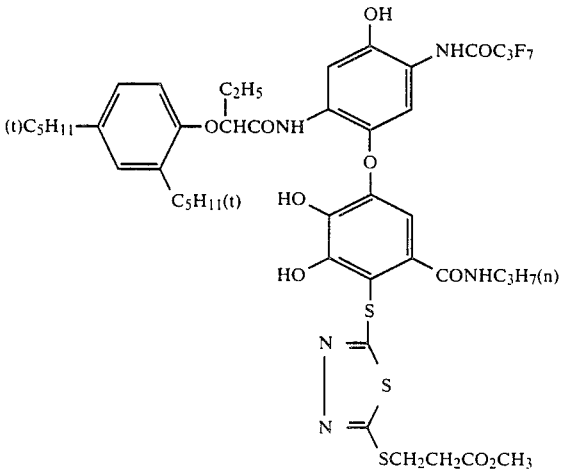
ExC-(4)
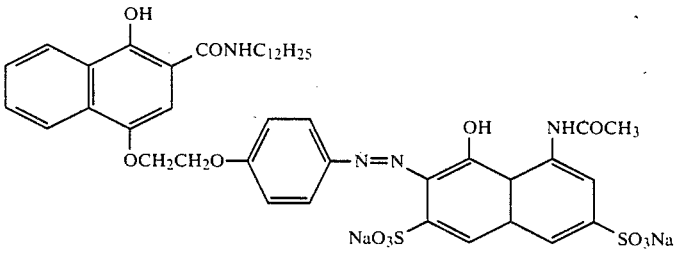
ExC-(5)
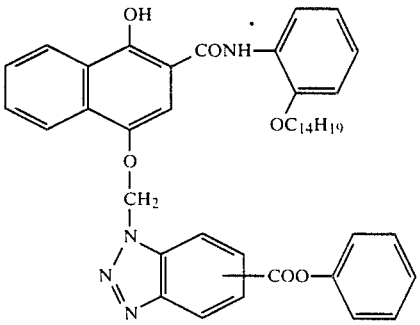

-continued
ExC-(6)
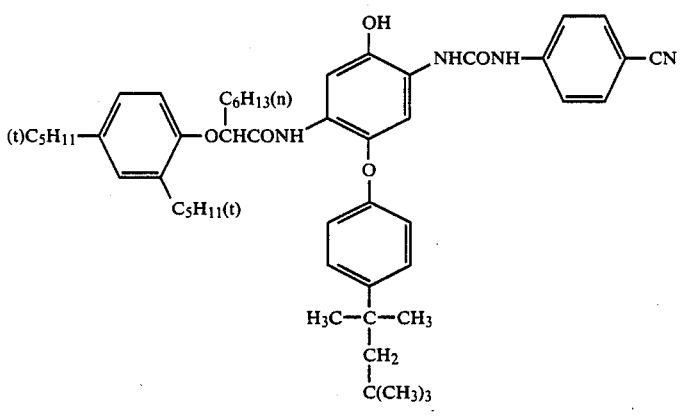
ExC-(7)
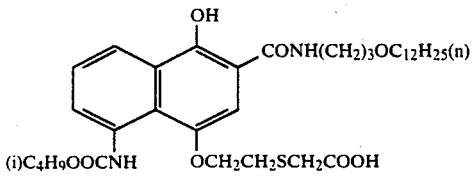
ExM-(8)
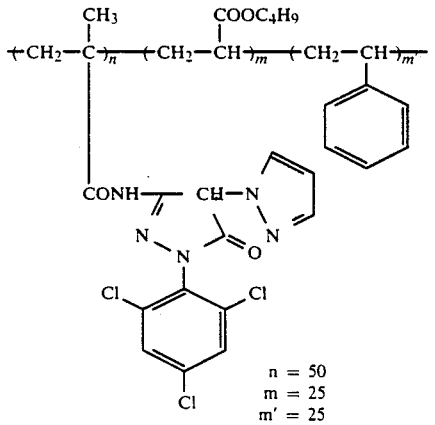
n = 50
m = 25
m' = 25
mol. wt. Approx. 20,000
ExM-(9)
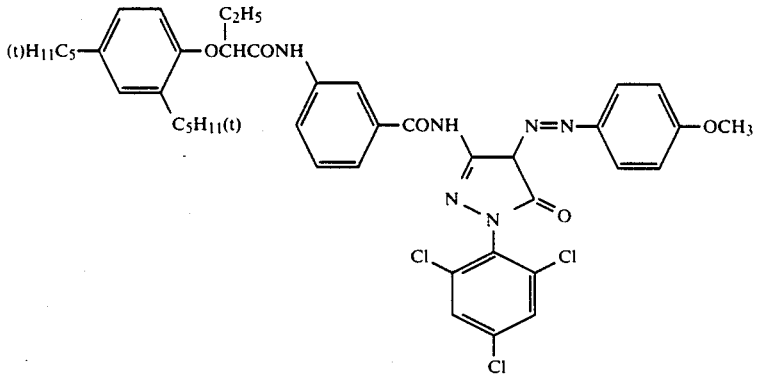

-continued
ExM-(10)
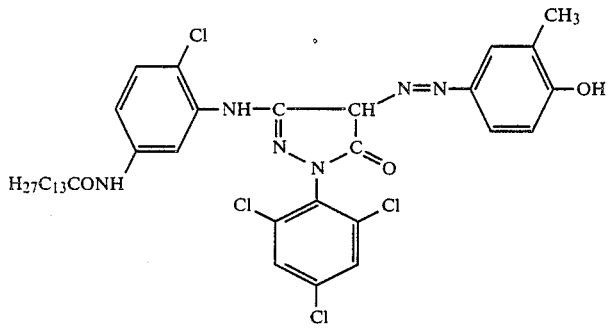
ExY-(11)
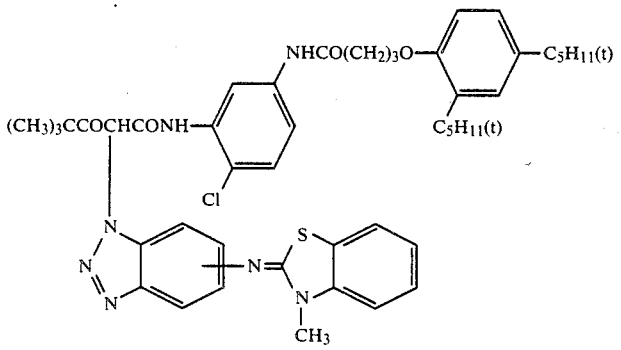
ExM-(12): same as Ex-7 in Example 1
ExY-(13): same as Ex-8 in Example 1
ExM-(14)
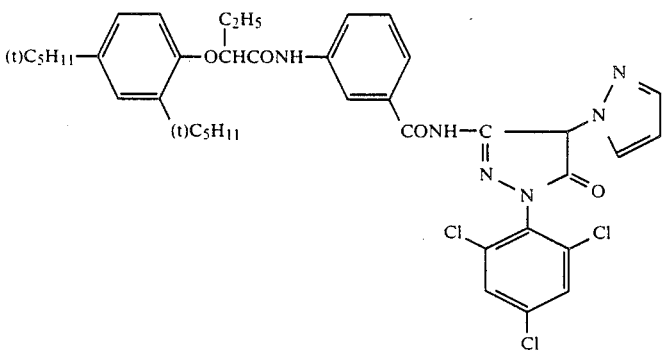
ExY-(15): same as Ex-9 in Example 1
ExC-(16)
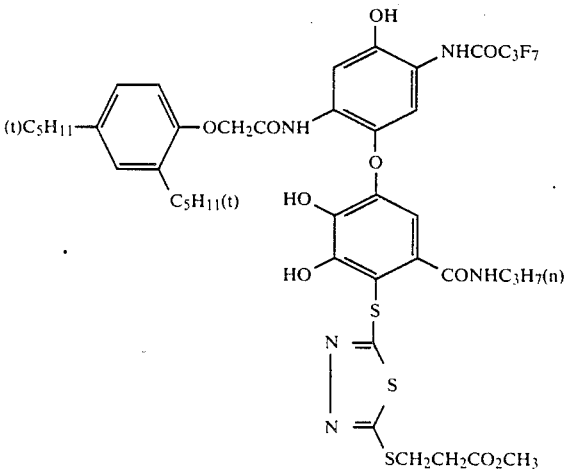

-continued

ExS-(1)

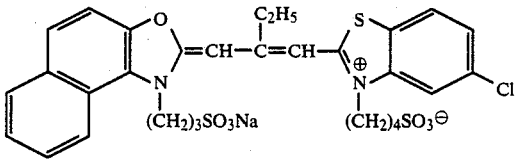

ExS-(2)

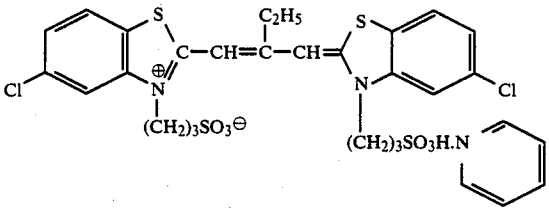

ExS-(3)

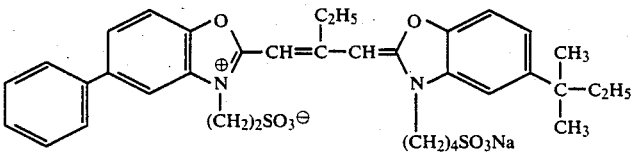

ExS-(4): same as sensitizing dye VII in Example 1
ExS-(5): same as sensitizing dye V in Example 1
ExS-(6): same as sensitizing dye VIII in Example 1
H-(1): same as H-1 in Example 1

ExF-(1)

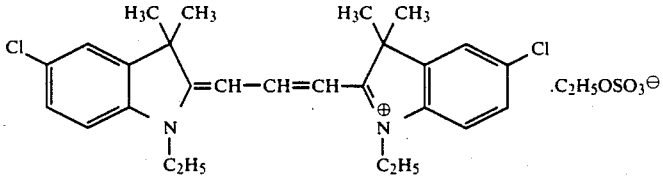

After exposing the color photographic photosensitive material produced as described above, processing was performed by the following method.

Processing Method

| Processing Step | Processing Time | Processing Temperautre (°C.) |
|---|---|---|
| Color Development | 2 min 30 sec | 40 |
| Bleach-Fixing | 2 min 30 sec | 40 |
| Washing (1) | 20 sec | 35 |
| Washing (2) | 20 sec | 35 |
| Stabilizing | 20 sec | 35 |
| Drying | 50 sec | 65 |

The compositions of the processing solutions were as follows:

| | |
|---|---|
| Color Developing Solution: | |
| Diethylenetriaminepentaacetic Acid | 2.0 g |
| 1-Hydroxyethylidene-1,1-diphosphonic Acid | 3.0 g |
| Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 4-(N-Ethyl-N-β-hydroxyethylamino)-2-methylaniline Sulfate | 4.5 g |
| Water to make | 1.0 liter |
| pH | 10.05 |
| Bleach-Fixing Solution: | |

-continued

| | |
|---|---|
| Bleaching Agent (ferric ammonium salts of organic chelating compound as described in Table 3) | 0.4 mol |
| Organic Chelating Compound (described in Table 3) | 0.05 mol |
| Sodium Sulfite | 5.0 g |
| Ammonium Thiosulfate Aqueous Solution (700 g/liter) | 260.0 ml |
| Acetic Acid (98 wt %) | 5.0 ml |
| Bleaching Accelerator | 0.01 mol |

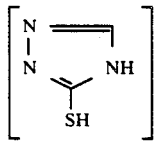

| | |
|---|---|
| Water to make | 1.0 liter |
| pH | 6.0 |

Washing Solution:

Tap water was passed through a mixed-bed type column packed with an H-type strong acid cation exchange resin (Amberlite IR-120B, manufactured by Rohm & Haas Co.) and an OH-type anion exchange resin (Amberlite IR-400, manufactured by Rohm & Haas Co.), and the calcium and magnesium ion concentration reduced to below 3 mg per liter. Then, 20 mg per liter of sodium dichloroioscyanurate and 1.5 g per liter of sodium sulfate were added. The pH of this solution lay in the range of 6.5 to 7.5.

| Stabilizing Solution | |
|---|---|
| Formaldehyde (37 wt %) | 2.0 ml |
| Polyoxyethylene-p-monononylphenyl Ether (average degree of polymerization: 10) | 0.3 g |
| Ethylenediaminetetraacetic Acid Disodium Salt | 0.05 g |
| Water to make | 1.0 liter |
| pH | 5.0 to 8.0 |

Using fluorescent X-ray analysis, measurements were made of the residual silver in the region of maximum density in the processed photographic material. The results are shown in Table 3.

TABLE 3

| No. | Organic Chelating Compound | Residual Silver ($\mu g/cm^2$) | Days until Blix Sulfided |
|---|---|---|---|
| 3-1 | Ethylenediaminetetraacetic Acid | 10.5 | 8 days |
| 3-2 | Iminodiacetic Acid | 7.5 | 1 days |
| 3-3 | Methyliminodiacetic Acid | 5.9 | 5 days |
| 3-4 | Hydroxyethyliminodiacetic Acid | 50.3 | 10 days or more |
| 3-5 | Specified Compound X- 1 | 4.7 | 10 days or more |
| 3-6 | Specified Compound X-2 | 5.4 | 10 days or more |
| 3-7 | Specified Compound X-3 | 5.2 | 10 days or more |
| 3-8 | Specified Compound X-5 | 4.9 | 10 days or more |
| 3-9 | Specified Compound X-6 | 5.5 | 10 days or more |
| 3-10 | Specified Compound X-8 | 5.6 | 10 days or more |
| 3-11 | Specified Compound X-10 | 5.4 | 10 days or more |

As is clear from Table 3, in the case where an organic chelating compound for a bleaching agent of the present invention was used, the residual silver was low and an excellent image could be obtained. Moreover, the bleach-fixing solution obtained had sufficient stability.

EXAMPLE 4

The multilayer color photographic photosensitive material produced in Example 3 was cut into the form of 35 mm wide roll film, exposed, and then, using a Fuji Photo Film (Co.) FP350 automatic developing machine, processed by the method described below (until the cumulative level of replenishment of the color developing solution reached 3 times the capacity of the mother liquor tank).

Processing Method:

| Processing Step | Processing Time | Processing Temperature (°C.) | Amount of Replenishment (ml) | Tank Capacity (liters) |
|---|---|---|---|---|
| Color Development | 3 min 15 sec | 38 | 45 | 10 |
| Bleaching | 30 sec | 38 | 20 | 4 |
| Blixing | 2 min 00 sec | 38 | 30 | 8 |
| Washing (1) | 40 sec | 35 | Counter-current supply from (2) to (1) | 4 |
| Washing (2) | 1 min 00 sec | 35 | 30 | 4 |
| Stabilizing | 40 sec | 38 | 20 | 4 |
| Drying | 1 min 15 sec | 55 | — | — |

The replenishment amount is per meter length of 35 mm wide film.

The compositions of the processing solutions were as follows:

| | Mother Liquor (tank soln.) | Replenisher |
|---|---|---|
| Color Developing Solution: | | |
| Diethylenetriaminepentaacetic Acid | 1.0 g | 1.1 g |
| 1-Hydroxyethylidene-1,1-diphosphonic Acid | 3.0 g | 3.2 g |
| Sodium Sulfite | 4.0 g | 4.4 g |
| Potassium Carbonate | 30.0 g | 37.0 g |
| Potassium Bromide | 1.4 g | 0.7 g |
| Potassium Iodide | 1.5 mg | — |
| Hydroxylamine Sulfate | 2.4 g | 2.8 g |
| 4-(N-Ethyl-N-β-hydroxyethylamino)-2-methylaniline Sulfate | 4.5 g | 5.5 g |
| Water to make | 1.0 l | 1.0 l |
| pH | 10.05 | 10.10 |
| Bleaching Solution | | |
| (mother liquor (tank solution) and replenisher were the same) | | |
| Bleaching Agent (ferric ammonium salts of organic chelating compounds as described in Table 4) | 0.5 mol | |
| Chelating Compound (ferric ammonium salts of organic chelating compounds as described in Table 4) | 0.05 mol | |
| Ammonium Bromide | 100.0 g | |
| Ammonium Nitrate | 10.0 g | |
| Bleaching Accelerator | 0.005 mol | |

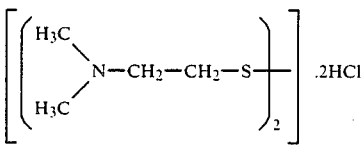

| | | |
|---|---|---|
| Aqueous Ammonia (27 wt %) | 15.0 ml | |
| Water to make | 1.0 liter | |
| pH | 6.3 | |
| Bleach-Fixing Solution | | |
| (mother liquor (tank solution) and replenisher were the same) | | |
| Bleaching Agent (identical to that in the bleaching solution) | 0.3 mol | |
| Chelating Compound (identical to that in the bleaching solution) | 0.05 mol | |
| Sodium Sulfite | 12.0 g | |
| Aqueous Ammonium Thiosulfate Solution (700 g/liter) | 240.0 ml | |
| Aqueous Ammonia (27 wt %) | 6.0 ml | |
| Water to make | 1.0 liter | |
| pH | 7.2 | |

Washing Solution (mother liquor (tank solution) and replenisher were the same)

Tap water was passed through a mixed-bed type column packed with an H-type strong acid cation exchange resin (Amberlite IR-120B, manufactured by Rohm & Haas Co.) and an OH-type anion exchange resin (Amberlite IR-400, manufactured by Rohm &

Haas Co.), and the calcium and magnesium ion concentration reduced to below 3 mg per liter. Then, 20 mg per liter of sodium dichloroisocyanurate and 1.5 g per liter of sodium sulfate were added. The pH of this solution lay in the range of 6.5 to 7.5.

| Stabilizing Solution (mother liquor (tank solution) and replenisher were the same) | |
|---|---|
| Formaldehyde (37 wt %) | 2.0 ml |
| Polyoxyethylene-p-monononylphenyl Ether (average degree of polymerization: 10) | 0.3 g |
| Ethylenediaminetetraacetic Acid Disodium Salt | 0.05 g |
| Water to make | 1.0 liter |
| pH | 5.0 to 8.0 |

Exposed photosensitive materials were processed in the same manner as in Example 3 using the various processing solutions following continuous treatment, and measurements were made of the residual amount of silver in the region of maximum density by means of fluorescent X-ray analysis. The results are shown in Table 4.

TABLE 4

| No. | Organic Chelating Compound | Residual Silver ($\mu g/cm^2$) | Maximum Cyan Density |
|---|---|---|---|
| 4-1 | Ethylenediaminetetraacetic Acid* | 15.9 | 1.43 |
| 4-2 | Specified Compound X-1** | 5.1 | 1.62 |
| 4-3 | Specified Compound X-2** | 5.2 | 1.60 |
| 4-4 | Specified Compound X-3** | 5.5 | 1.63 |
| 4-5 | Specified Compound X-5** | 5.7 | 1.59 |

*Comparative sample
**Sample in accordance with the present invention

As is clear from Table 4, where an organic chelating compound for a bleaching agent of the present invention was used, there was little residual silver. Further, the cyan density after treatment was high and there was little recoloring problem, so that an excellent image was obtained.

EXAMPLE 5

A multilayer photographic paper with a layer structure as described below was produced on a paper base which had been laminated on both faces with polyethylene. The coating solutions were prepared as follows:

Preparation of the First Layer Coating Solution:

27.2 ml of ethyl acetate and 7.7 ml (8.0 g) of high boiling solvent (Solv-1') were added to 19.1 g of yellow coupler (ExY-1') and 4.4 g of color image stabilizer (Cpd-1'), and a solution was formed. This solution was emulsified and dispersed in 185 ml of a 10 wt % aqueous gelatin solution which contained 8 ml of a 10 wt % sodium dodecylbenzenesulfonate. This emulsion dispersion was mixed with emulsions EM7 and EM8, the gelatin concentration was adjusted to the composition specified below and the first layer coating solution was obtained. The coating solutions for the second layer through the seventh layer were also prepared in an identical manner to the first layer coating solution. 1-Oxy-3,5-dichloro-s-triazine sodium salt was used as a gelatin hardener for each layer.

Further, Cpd-2 was used as a thickener.

Layer Structure:

The composition of each layer is shown below. The numbers given indicate the coverage ($g/m^2$). In the case of the silver halide emulsion, coverage is based on conversion to silver.

Support: Polyethylene-Laminated Paper

The polyethylene on the first layer side contained white pigment ($TiO_2$) and bluing dye.

| | |
|---|---|
| First Layer: Blue-Sensitive Layer | |
| Monodispersed Silver Chlorobromide Emulsion EM7 spectrally sensitized with Sensitizing Dye ExS-1' | 0.15 |
| Monodispersed Silver Chlorobromide Emulsion EM8 spectrally sensitized with Sensitizing Dye ExS-1' | 0.15 |
| Gelatin | 1.86 |
| Yellow Coupler ExY-1' | 0.82 |
| Color Image Stabilizer Cpd-2' | 0.19 |
| Solvent Solv-1' | 0.35 |
| Second Layer: Color Mixing Preventing Layer | |
| Gelatin | 0.99 |
| Color Mixing Preventing Agent Cpd-3' | 0.08 |
| Third Layer: Green-Sensitive Layer | |
| Monodispersed Silver Chlorobromide Emulsion EM9 spectrally sensitized with Sensitizing Dyes ExS-2', ExS-3' | 0.12 |
| Monodispersed Silver Chlorobromide Emulsion EM10 spectrally sensitized with Sensitizing Dyes ExS-2', ExS-3' | 0.24 |
| Gelatin | 1.24 |
| Magenta Coupler ExM-1' | 0.39 |
| Color Image Stabilizer Cpd-4' | 0.25 |
| Color Image Stabilizer Cpd-5' | 0.12 |
| Solvent Solv-2' | 0.25 |
| Fourth Layer: Ultraviolet Absorbing Layer | |
| Gelatin | 1.60 |
| Ultraviolet Absorbent (Cpd-6'/Cpd-7'/Cpd-8' = 3/2/6 (weight ratio)) | 0.70 |
| Color Mixing Preventing Agent Cpd-9' | 0.05 |
| Solvent Solv-3' | 0.42 |
| Fifth Layer: Red-Sensitive Layer | |
| Monodispersed Silver Chlorobromide Emulsion EM11 spectrally sensitized with Sensitizing Dyes ExS-4', ExS-5' | 0.07 |
| Monodispersed Silver Chlorobromide Emulsion EM12 spectrally sensitized with Sensitizing Dyes ExS-4', ExS-5' | 0.16 |
| Gelatin | 0.92 |
| Cyan Coupler ExC-1' | 1.46 |
| Cyan Coupler ExC-2' | 1.84 |
| Color Image Stabilizer (Cpd-7'/Cpd-8'/Cpd-10' = 3/4/2 (weight ratio)) | 0.17 |
| Polymer for Dispersion Cpd-11' | 0.14 |
| Solvent Solv-1' | 0.20 |
| Sixth Layer: Ultraviolet Absorbing Layer | |
| Gelatin | 0.54 |
| Ultraviolet Absorbing Agent (Cpd-6'/Cpd-8'/Cpd-10' = 1/5/3 (weight ratio)) | 0.21 |
| Solvent Solv-4' | 0.08 |
| Seventh Layer: Protective Layer | |
| Gelatin | 1.33 |
| Polyvinyl alcohol acrylic-modified copolymer (degree of modification: 17%) | 0.17 |
| Liquid paraffin | 0.03 |

Further, Cpd-12' and Cpd-13' were used as irradiation preventing dyes at this time.

In the layers, Alkanol XC (Du Pont Ltd.), sodium alkylbenzenesulfonate, succinate ester and Magefacx F-120 (manufactured by Dainippon Ink Co., Ltd.) were used as emulsification or dispersion agents or coating aids. Cpd-14' and Cpd-15' were used as a silver halide stabilizer.

Details of the emulsions used are as follows.

| Emulsion Name | Shape | Grain Diameter (μm) | Br Content (mol %) | Coefficient of Variation* |
|---|---|---|---|---|
| EM7 | Cubic | 1.1 | 1.0 | 0.10 |
| EM8 | " | 0.8 | 1.0 | 0.10 |
| EM9 | " | 0.45 | 1.5 | 0.09 |
| EM10 | " | 0.34 | 1.5 | 0.09 |
| EM11 | " | 0.45 | 1.5 | 0.09 |

-continued

| Emulsion Name | Shape | Grain Diameter (μm) | Br Content (mol %) | Coefficient of Variation* |
|---|---|---|---|---|
| EM12 | " | 0.34 | 1.6 | 0.10 |

*expresses grain distribution = $\frac{\text{Standard Deviation}}{\text{Average Size}}$ The structures of the compounds used are as follows:

ExY-1'

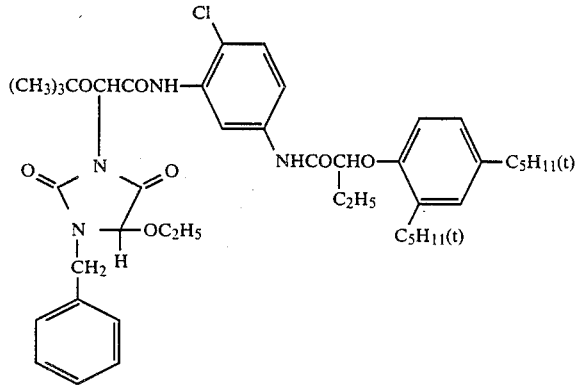

ExM-1'

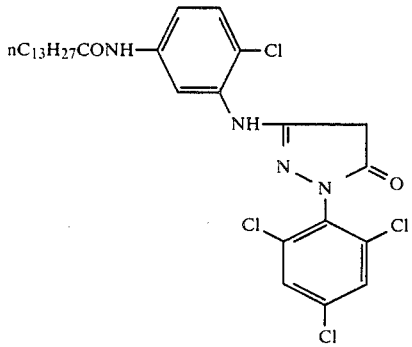

ExC-1'

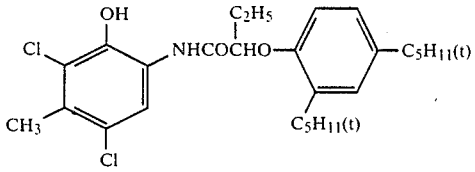

ExC-2'

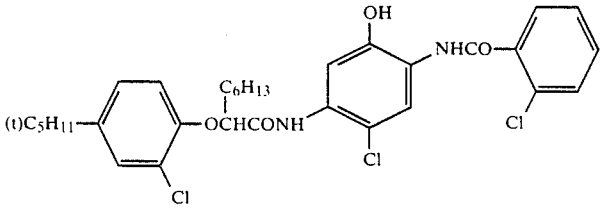

ExS-1'

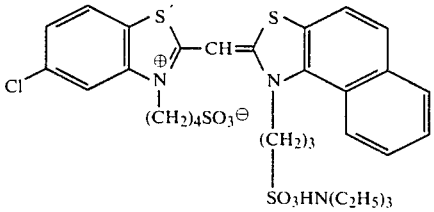

-continued
ExS-2'
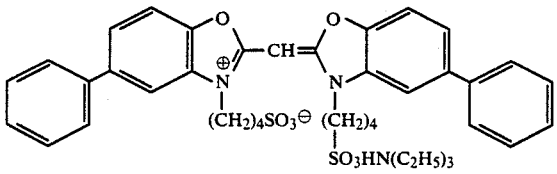
ExS-3'
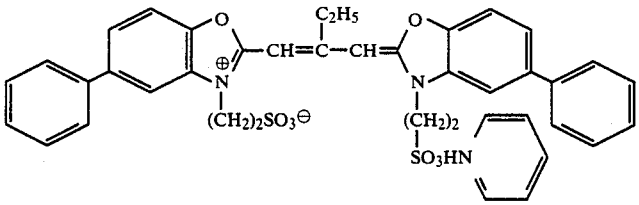
ExS-4'
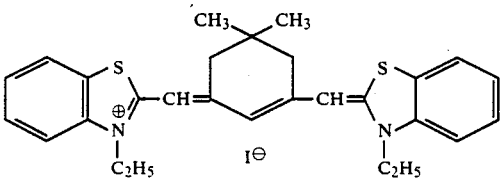
ExS-5'
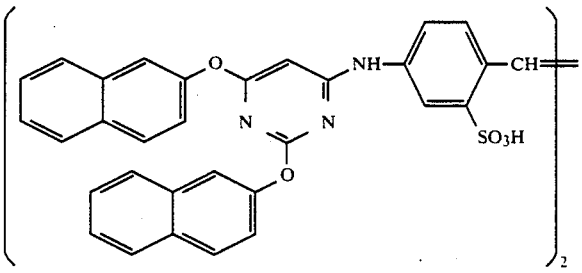
Cpd-1'
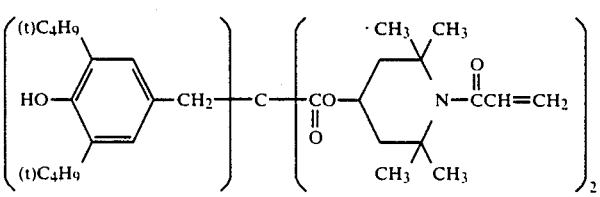
Cpd-2'
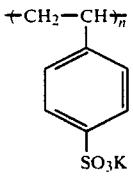
Cpd-3'
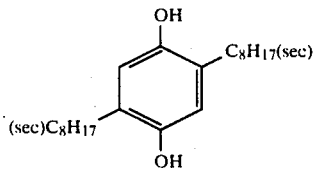
Cpd-4'
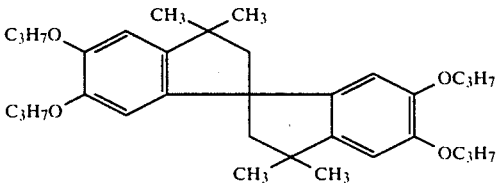

-continued

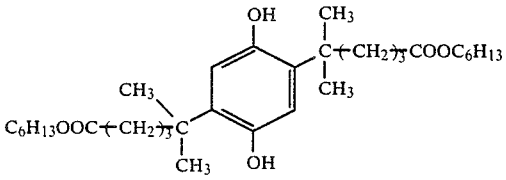

Cpd-5'

Cpd-6': same as U-1 in Example 1
Cpd-7': same as U-2 in Example 1
Cpd-8': same as U-3 in Example 1

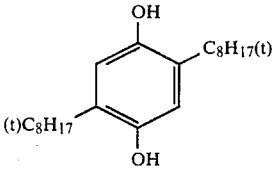

Cpd-9'

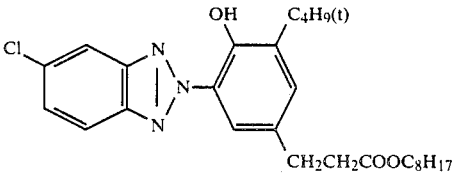

Cpd-10'

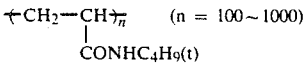

Cpd-11'

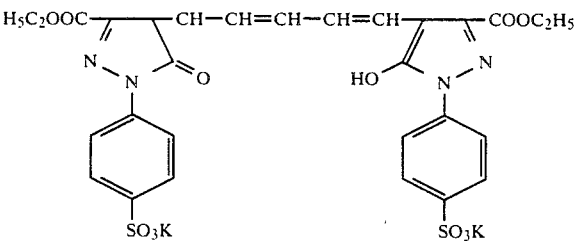

Cpd-12'

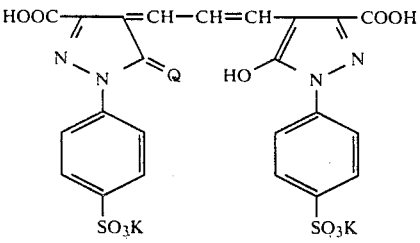

Cpd-13'

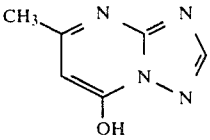

Cpd-14'

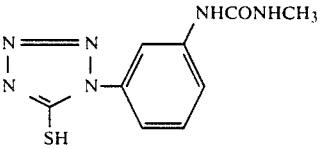

Cpd-15'

Solv-1' dibutyl phthalate
Solv-2' trioctyl phosphate
Solv-3' trinonyl phosphate
Solv-4' tricresyl phosphate After exposing the above photosensitive materials through an optical wedge, treatment was performed by the following processes.

Processing Method

| Processing Step | Time (sec) | Temperature (°C.) |
|---|---|---|
| Color Development | 45 | 35 |
| Bleach-Fixing | 25 | 30–35 |
| Rinsing (1) | 20 | 30–35 |
| Rinsing (2) | 20 | 30–35 |
| Rinsing (3) | 20 | 30–35 |
| Rinsing (4) | 30 | 30–35 |
| Drying | 60 | 70–80 |

(A four-tank countercurrent system from rinsing (4) to rinsing (1) was employed.)

The composition of each of the processing solutions was as follows:

| | |
|---|---|
| Color Developing Solution: | |
| Water | 800 ml |
| Ethylenediamine-N,N,N,N—tetramethylene-phosphonic Acid | 1.5 g |
| Triethylenediamine(1,4-diazabicyclo-[2,2,2]octane) | 5.0 g |
| Sodium Chloride | 1.4 g |
| Potassium Carbonate | 25 g |
| N—Ethyl-N—(β-methanesulfonamidoethyl)-3-methyl-4-aminoaniline Sulfate | 5.0 g |
| N,N—Diethylhydroxylamine | 4.2 g |
| Brightening Agent; 4,4'-diamino-stilbene type, "UVITEX-CK", manufactured by Ciba Geigy Co., Ltd.) | 2.0 g |
| Water to make | 1,000 ml |
| pH (25° C.) | 10.10 |
| Bleach-Fixing Solution: | |
| Water | 400 ml |
| Ammonium Thiosulfate (700 g/liter) | 100 ml |
| Sodium Sulfite | 18 g |
| Bleaching Agent (ferric ammonium salt of organic chelating compound as described in Table 5) | 0.5 mol |
| Organic Chelating Compound (described in Table 5) | 0.05 mol |
| Ammonium Bromide | 40 g |
| Glacial Acetic Acid | 8 g |
| Water to make | 1,000 ml |
| pH (25° C.) | 5.5 |

Rinsing Solution:

Ion exchange water (content of calcium and magnesium both: below 3 ppm)

The amount of residual silver in the region of maximum color density was measured by fluorescent X-ray analysis for each of the photosensitive materials treated as described above. The results are shown in Table 5.

TABLE 5

| No. | Organic Chelating Compound | Residual Silver ($\mu g/cm^2$) | Notes |
|---|---|---|---|
| 5-1 | Ethylenediaminetetraacetic Acid | 5.4 | Comparison |
| 5-2 | Iminodiacetic Acid | 5.0 | Comparison |
| 5-3 | Methyliminodiacetic Acid | 3.9 | Comparison |
| 5-4 | Hydroxyethyliminodiacetic Acid | 41.8 | Comparison |
| 5-5 | Specific Compound X-1 | 2.9 | Invention |
| 5-6 | Specific Compound X-2 | 3.1 | Invention |
| 5-7 | Specific Compound X-3 | 3.3 | Invention |
| 5-8 | Specific Compound X-4 | 3.5 | Invention |
| 5-9 | Specific Compound X-5 | 3.2 | Invention |
| 5-10 | Specific Compound X-6 | 3.6 | Invention |
| 5-11 | Specific Compound X-7 | 3.9 | Invention |
| 5-12 | Specific Compound X-8 | 3.9 | Invention |
| 5-13 | Specific Compound X-9 | 3.6 | Invention |
| 5-14 | Specific Compound X-10 | 3.3 | Invention |
| 5-15 | Specific Compound X-11 | 3.2 | Invention |
| 5-16 | Specific Compound X-12 | 3.2 | Invention |

As is clear from Table 5, in the case where a specific compound represented by formula (X) was used as the organic chelating compound for the bleaching agent, there was little residual silver as compared to the use of a comparative compound and an excellent image was obtained.

While the invention has been described in detail and with reference to specific embodiments thereof, it will be apparent to one skilled in the art that various changes and modifications can be made therein without departing from the spirit and scope thereof.

What is claimed is:

1. A method for processing an exposed silver halide color photographic material comprising the steps of:

(1) color developing said material, and then (2) bleaching or bleach-fixing said material using a processing solution, wherein said processing solution has a bleaching capability and contains at least a ferric complex salt of an organic chelating compound represented by formula (X):

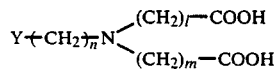

(X)

wherein Y represents

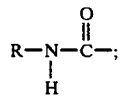

l, m and n each represents an integer of from 1 to 3 which may be the same or different; and R represents a hydrogen atom or a substituted or unsubstituted alkyl group having from 1 to 4 carbon atoms.

2. The method for processing an exposed silver halide color photographic material as claimed in claim 1, wherein l, m and n each represents an integer of 1 or 2; and R represents a hydrogen atom, a methyl group, or an ethyl group.

3. The method for processing an exposed silver halide color photographic material as claimed in claim 1, wherein said processing solution contains a bleaching agent in an amount of from 0.05 mol to 1.0 mol per liter of the processing solution.

4. The method for processing an exposed silver halide color photographic material as claimed in claim 1, wherein said processing solution being a bleaching solution contains a bleaching agent in an amount of from 0.1 mol to 1 mol per liter of the bleaching solution.

5. The method for processing an exposed silver halide color photographic material as claimed in claim 1, wherein said processing solution being a bleach-fixing solution contains a bleaching agent in an amount of from 0.05 mol to 0.5 mol per liter of the bleach-fixing solution.

6. The method for processing an exposed silver halide color photographic material as claimed in claim 1, wherein said processing solution further contains at least one of a ferric complex salt of an aminopolycarboxylic acid or an aminopolycarboxylic acid compound of a ferric aminopolycarboxylic acid complex salt.

7. The method for processing an exposed silver halide color photographic material as claimed in claim 1, wherein said processing solution contains a fixing agent in an amount of 3 mol or less per liter of the processing solution.

* * * * *